US007467973B2

(12) United States Patent
Lee et al.

(10) Patent No.: US 7,467,973 B2
(45) Date of Patent: Dec. 23, 2008

(54) COAXIAL CONNECTOR, PIN DIELECTRIC AND MAIN BODY FOR SUCH COAXIAL CONNECTOR, ASSEMBLING METHOD OF THE COAXIAL CONNECTOR, AND MALE CONNECTOR

(75) Inventors: Hai-Young Lee, Gyeonggi-do (KR); Sang-Ki Lee, Gyeongsangbuk-do (KR); Yong-Goo Lee, Seoul (KR); Kyoung-Il Kang, Gyeongsangnam-do (KR); Jang-Hyun Oh, Gyeongsanbuk-do (KR)

(73) Assignee: Gigalane Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/572,798

(22) PCT Filed: Dec. 31, 2004

(86) PCT No.: PCT/KR2004/003563

§ 371 (c)(1),
(2), (4) Date: Jan. 26, 2007

(87) PCT Pub. No.: WO2006/011703

PCT Pub. Date: Feb. 2, 2006

(65) Prior Publication Data

US 2007/0202726 A1 Aug. 30, 2007

(30) Foreign Application Priority Data

Jul. 29, 2004 (KR) ..... 10-2004-0059890

(51) Int. Cl.
*H01R 9/05* (2006.01)

(52) U.S. Cl. ..... 439/582

(58) Field of Classification Search ..... 439/582, 439/578, 581, 585
See application file for complete search history.

(56) References Cited

U.S. PATENT DOCUMENTS

| | | | | |
|---|---|---|---|---|
| 5,037,329 | A | 8/1991 | Wright | |
| 5,322,453 | A | 6/1994 | Resnick et al. | |
| 5,772,470 | A * | 6/1998 | Togashi | 439/582 |
| 5,886,590 | A * | 3/1999 | Quan et al. | 333/33 |
| 6,238,218 | B1 | 5/2001 | Baffert | |
| 6,503,100 | B2 * | 1/2003 | Yamane | 439/582 |
| 6,508,668 | B1 | 1/2003 | Yamane | |
| 6,572,407 | B1 * | 6/2003 | Ko | 439/582 |

(Continued)

*Primary Examiner*—Tulsidas C. Patel
*Assistant Examiner*—Vladimir Imas
(74) *Attorney, Agent, or Firm*—Portland IP Law, LLC

(57) ABSTRACT

Disclosed coaxial connector comprises (A) a pin having a soldering section to be soldered to a central conductor of the coaxial cable and a contact section extending from the soldering section and electrically interconnected to a male connector, (B) a dielectric block having a cylindrical portion including a through hole to which the pin is inserted, a body of chamfered structure and being connected to the cylindrical portion, and a cover leg extending from the body in an opposite direction from the cylindrical portion, and (C) a main body having a cylindrical portion including a hole for receiving the dielectric block to which the pin is inserted, a fastening flap for holding the coaxial cable, and a body electrically interconnected to the ground conductor of the coaxial cable. The coaxial connector of the present invention enables the soldering operation of the pin with the central conductor of the coaxial cable to be performed even after the components such as the pin, dielectric block and main body are assembled.

27 Claims, 44 Drawing Sheets

U.S. PATENT DOCUMENTS 6,712,645 B1 3/2004 Chou
6,739,907 B2 * 5/2004 Kuroda et al. ..... 439/582
6,790,082 B2 * 9/2004 Obayashi ..... 439/582
6,916,201 B1 * 7/2005 Chu ..... 439/582
2005/0239328 A1 * 10/2005 Nagata et al. ..... 439/582

* cited by examiner

SECTION E–E'

SECTION A–A'

SECTION B–B'

SECTION C–C'

VIEW D

SECTION F–F'

SECTION A–A'

SECTION B–B'

SECTION C–C'

SECTION D–D'

SECTION E–E'

SECTION C–C'

COAXIAL CONNECTOR, PIN DIELECTRIC AND MAIN BODY FOR SUCH COAXIAL CONNECTOR, ASSEMBLING METHOD OF THE COAXIAL CONNECTOR, AND MALE CONNECTOR

CROSS-REFERENCE TO RELATED APPLICATION

This application is a U.S. national phase application of PCT International Application No. PCT/KR2004/003563, filed Dec. 31, 2004, which claims priority of Korean Patent Application No. 2004-0059890, filed Jul. 29, 2004, the contents of which are incorporated herein by reference in their entirety.

TECHNICAL FIELD

The present invention relates to connector technologies, and more particularly to a coaxial connector by which soldering of a central conductor of a coaxial cable is possible even after the components for the connector are assembled. Further, the present invention relates to the components (such as pin, dielectric block, and main body) for the coaxial connector and a method for assembling the components as well as a male connector coupled to the coaxial connector.

BACKGROUND ART

FIG. 1 is a perspective view for illustrating the structure and manufacturing method of conventional coaxial connector. The conventional coaxial connector shown in FIG. 1 is disclosed in U.S. Pat. No. 6,508,668 assigned to Hirose Electric Co., Ltd. and entitled "L-Shaped Coaxial Connector and Terminal for the Same".

The conventional coaxial connector is comprised of a terminal 10, a dielectric block 20, and an outer conductor 30. Pluralities of terminals 10 are made from a metal strip so as to be coupled with a carrier 11 at regular intervals. Each terminal 10 has a connection section 12 and a contact section 13. The central conductor C4 of a cable C is soldered to the flat portion 12A of the connection section 12 and the terminal is cut off from the carrier 11 at a separation line 14. The dielectric block 20 is made of a molding of a dielectric material so as to provide a cylindrical portion section 21, a shoulder section 22 extending radially from the upper portion of the body section 21, and an inner cover section 23 extending upward from a position diametrically opposite to the shoulder section 22. The body section 21 has a central cavity 24 therein to accommodate the contact section 13 of the terminal 10 and an upper face 25 to support the connection section 12 of the terminal 10. The dimension of the inner cover section 23 is such that when it is bent, the inner cover section 23 is accommodated in the area of the upper face 25. The outer conductor 30 is made from a metal sheet so as to provide a cylindrical section 31 and an outer cover section 32. The cylindrical section 31 has such a dimension as to accommodate the body section 21 to form an annular space between them for receiving the outer conductor of a mating connector therein. An enclosure section 33 extends laterally from the cylindrical section 31 to surround the sides of the shoulder section 22. The outer cover section 32 has a flat cover portion 32D for covering the tubular section 31 and holding sections 32C and 32B deformed to hold the jacket C1 and the shield wire C2, respectively, when the outer cover 32 is bent toward the cylindrical section 31 at a narrowed base portion 32A. Between the holding sections 32C and 32B and the flat cover section 32D, a pair of tabs 32E are provided, which are to be bent at grooves 32F so as to hold the bottom of the shoulder section 22.

The conventional connector shown in FIG. 1 is manufactured by sequentially soldering the central conductor C4 of the coaxial cable C to the terminal 10, coupling the soldered structure to the dielectric block 20 and outer conductor 30, and holding the coaxial cable C by the outer conductor 30.

In the conventional coaxial connector, the terminal (also referred to as "pin") is too small (for instance, the length of the pin is no more than 1.5 mm to 2.0 mm), and thus the soldering operation of the central conductor of the coaxial cable to the pin is extremely difficult that demands great caution and minute attention. Further, the components consisting of the coaxial connector are very small in size and assembling thereof is difficult. Moreover, the components itself cannot be provided to the users but must be provided in the finished connector product, because the coaxial cable has to be soldered first. If the users are provided with the components for the connector, they may customize the coaxial connector to suit their needs by e.g., changing the length of the coaxial cable. Further, the providers of the components are advantageous in that the process is made simple and production cost can be reduced.

Moreover, for using the UFL type connectors of small sized in high frequency devices such as mobile telephones, wireless telecommunication devices, electronic measuring equipments and GPSs, improved electrical isolation characteristics, exact impedance matching, signal integrity and enhanced propagation properties are needed.

DISCLOSURE OF THE INVENTION

A purpose of the present invention is to provide an improved coaxial connector that can be manufactured by more simple process and enhance the productivity.

Other purpose of the present invention is to provide an improved coaxial connector that can be customized by users and is easy to assemble.

Another purpose of the present invention is to introduce new structure of coaxial connectors that can be provided either by finished product or in a form of individual components. Still another purpose of the present invention is to improve the electrical characteristics of coaxial connectors.

According to a first aspect of the present invention, an improved coaxial connector comprises (A) a pin having a soldering section to be soldered to a central conductor of the coaxial cable and a contact section extending from the soldering section and electrically interconnected to a male connector, (B) a dielectric block having a cylindrical portion including a through hole to which the pin is inserted, a body of chamfered structure and being connected to the cylindrical portion, and a cover leg extending from the body in an opposite direction from the cylindrical portion, and (C) a main body having a cylindrical portion including a hole for receiving the dielectric block to which the pin is inserted, a fastening flap for holding the coaxial cable, and a body electrically interconnected to the ground conductor of the coaxial cable. The coaxial connector of the present invention enables the soldering operation of the pin with the central conductor of the coaxial cable to be performed even after the components such as the pin, dielectric block and main body are assembled. The body of the dielectric block includes shoulder portions for forming a space in an opposite position of the cover leg, and the cylindrical portion of the main body includes fold fastening means extending, in parallel, from the cylindrical portion and forming a space between the fold fastening means, so that the soldering section of the pin and the central conductor of the coaxial cable are soldered through both the space between the fold fastening means and the space in the dielectric block.

According to second aspect of the present invention, the cylindrical portion of the main body forms a space between fold fastening means extending, in parallel, from the cylindrical portion, and a plurality of fastening flaps have an interval that is enough to accommodate the space between the fold fastening means.

The body of the dielectric block may have chamfered structure. The overall height of the coaxial connector when it is coupled to a male connector may be reduced to e.g., 1.8 mm.

The third aspect of the present invention relates to the pin, dielectric block and main body suitable for use in the coaxial connector of the first and second embodiments.

According to fourth aspect of the present invention, a method for assembling components (pin, dielectric block and main body) for a coaxial connector by: (i) coupling the pin to the dielectric block by inserting the contact section of the pin into the through hole of the dielectric block; (ii) coupling the dielectric block into the hole formed in the cylindrical portion of the main body; (iii) bending by 90 degrees the cylindrical portion of the main body; (iv) soldering the central conductor of the coaxial cable and the soldering section of the pin after inserting the coaxial cable to the main body so that the central conductor of the coaxial cable reaches to the soldering section of the pin; and (v) bending the contact section of the main body to fix the coaxial cable.

In an embodiment of the present invention, the coaxial connector electrically and mechanically interconnected to a coaxial cable having a central conductor and ground conductor, comprises: a pin having a soldering section to be soldered to a central conductor of the coaxial cable and a contact section extending from the soldering section and electrically interconnected to a male connector; a dielectric block having a cylindrical portion including a through hole to which the pin is inserted, a body connected to the cylindrical portion, and a cover leg extending from the body in an opposite direction from the cylindrical portion; a main body having a cylindrical portion including a hole for receiving the dielectric block to which the pin is inserted, a fastening flap for holding the coaxial cable, and a body electrically interconnected to the ground conductor of the coaxial cable. The body of the dielectric block includes shoulder portions for forming a space in an opposite position of the cover leg, and the cylindrical portion of the main body includes fold fastening means extending, in parallel, from the cylindrical portion and forming a space between the fold fastening means, so that the soldering section of the pin and the central conductor of the coaxial cable are soldered through both the space between the fold fastening means and the space in the dielectric block. The main body has an embossed portion for receiving the cover leg of the dielectric block when the dielectric block is inserted into the cylindrical portion of the main body.

BEST MODES FOR CARRYING OUT THE INVENTION

With reference to the attached drawings, preferred embodiments of the present invention will be described.

First Embodiment

The coaxial connector of the first embodiment includes a pin, a dielectric block and a main body and the structures of these components are described with reference to FIGS. 2 to 4.

Figure 2A:
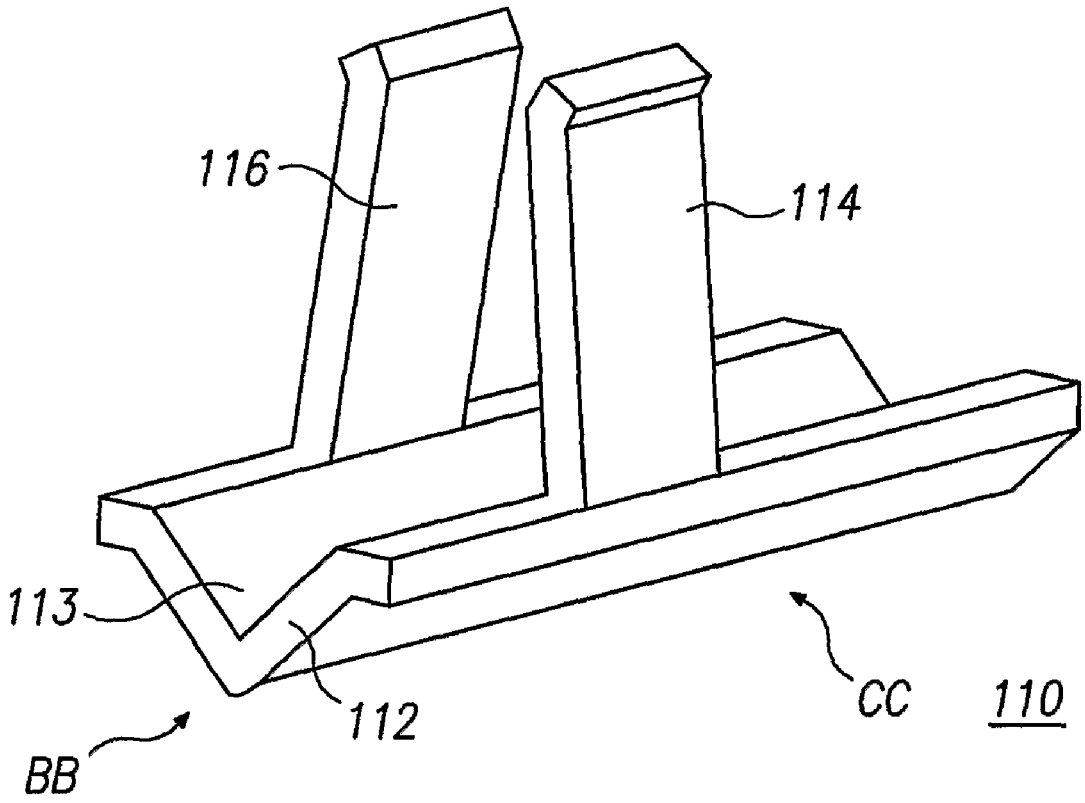
FIG. 2A is a perspective view of a pin that is suitable for use in a coaxial connector of the first embodiment of the present invention.
Figure 2B:
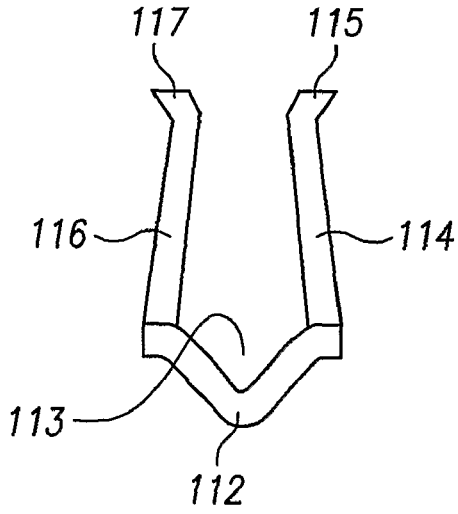
FIGS. 2B and 2C are side views of the pin in FIG. 2A when viewed along the directions BB and CC, respectively.
Figure 2C:
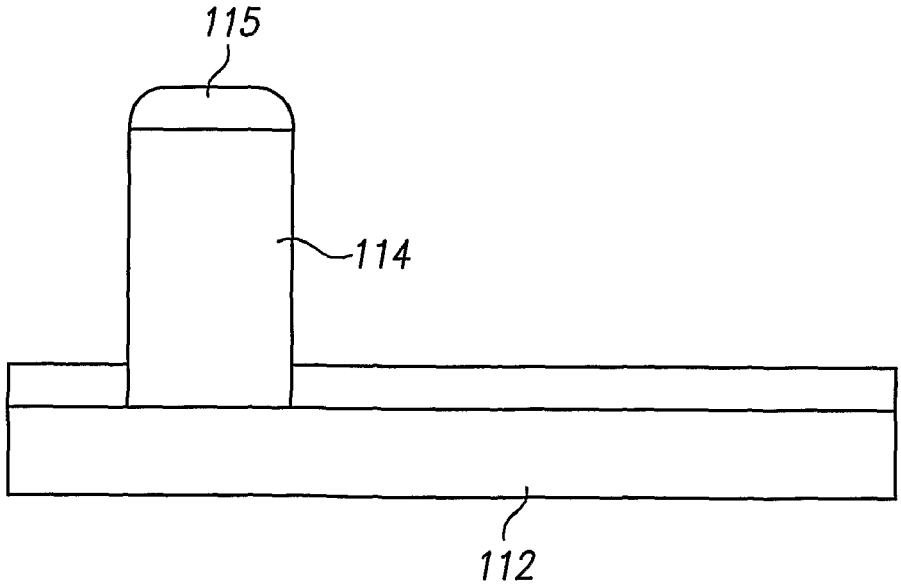
Figure 3A:
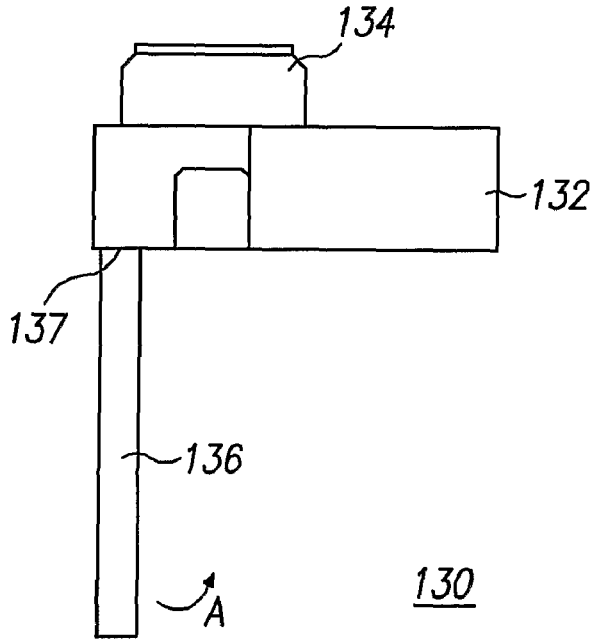
FIGS. 3A to 3E are front view, side view, upper side view, bottom side view and cross sectional view of a dielectric block that is suitable for use in the coaxial connector of the first embodiment of the present invention, respectively.
Figure 3B:
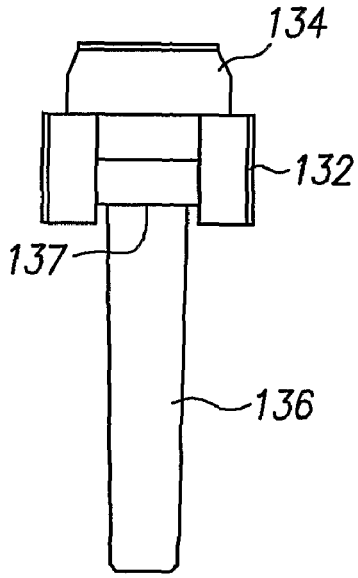
Figure 3C:
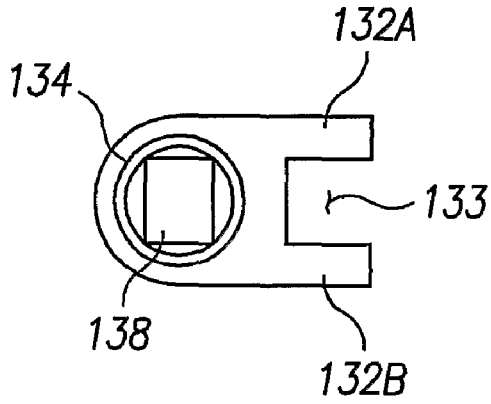
Figure 3D:
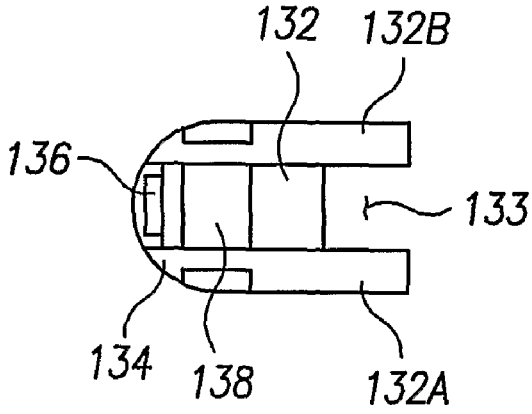
FIG. 3D PRIOR ART
Figure 3E:
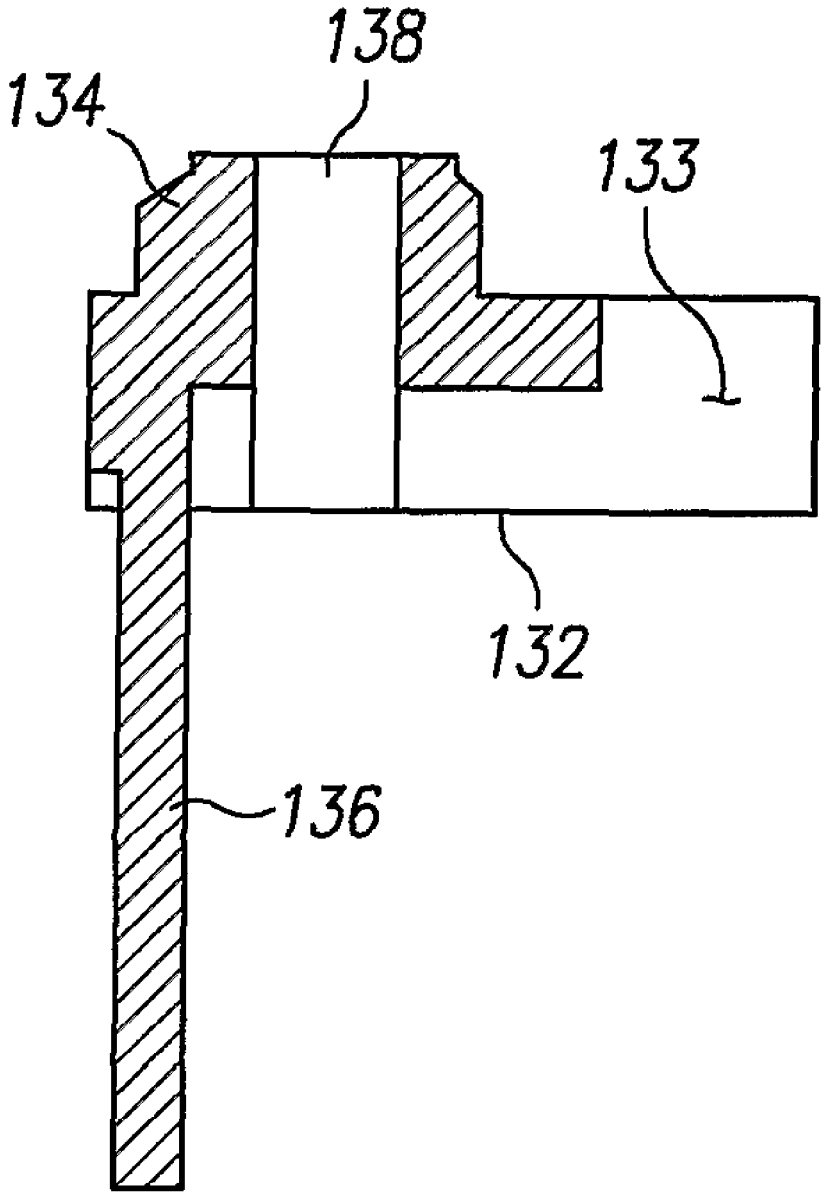

FIGS. 2A to 2C show a pin 110 suitable for use in a coaxial connector of the first embodiment. The pin 110 corresponds to the terminal 10 of the conventional coaxial connector, and may be made of an alloy such as phosphorous bronze and beryllium-copper (Be—Cu).

Referring to FIG. 2, the pin 110 includes a soldering section 112 having V- or U-shaped cross section and two contact sections 114 and 116 extending upwardly from the soldering section 112. The soldering section 112 has a bent structure of V or U extending longitudinally and has a groove 113 formed in the central portion of the soldering section 112. To the groove 113 of the soldering section 112 is soldered a central conductor ('178' of FIG. 5) of a coaxial cable. The length of the soldering section 112 has to be enough so that an operator can solder the central conductor of the coaxial cable to the surface of the soldering section 112.

First and second contact sections 114 and 116 of the pin 110 are electrically interconnected to an external male connector ('300' of FIG. 7) and electrically interconnect the central conductor of coaxial cable to a terminal ('310' of FIG. 7) of the male connector. The first and second contact sections 114 and 116 do not extend, in parallel to each other, or perpendicularly from the soldering section 112. Rather, the first and second contact sections 114 and 116 incline inwardly by a predetermined angle (e.g., 14 degrees). The inwardly inclined structure makes easy the insertion of pin 110 into the hole ('138' of FIG. 3) of the dielectric block and improves the electrical connection of the pin 110 with the terminal of the external male connector. The end portions 115 and 117 of the contact sections 114 and 116 are widened outwardly by a predetermined angle (e.g., 60 degrees), which is opposite in inclination of the contact sections 114 and 116. This enables for the end portions 115 and 117 to prevent the pin being released from the hole.

FIGS. 3A to 3E shows the dielectric block 130 suitable for use in the coaxial connector of the present invention. The dielectric block 130 may be made from PBT+15% G. F. material and be subjected to a finish process with UL94V-0.

Referring to FIG. 3, the dielectric block 130 includes a dielectric body 132, a cylindrical portion 134 and a cover leg 136. The cylindrical portion 134 is formed upper side of the dielectric body 132 and the long cover leg 136 extends downwardly from the dielectric body 132. In the cylindrical portion 134, a through hole 138 is formed as shown in FIG. 3E for the insertion of the pin 110 as explained above. More specifically, two contact sections 114 and 116 of the pin 110 are inserted into the hole 138. The cover leg 136 extending from the dielectric block 132 can be bent to direction A as shown in FIG. 3A with reference to the connection surface 137 connected to the dielectric body 132. The cover leg 136 has a length so that the soldering section 112 of the pin 110 is sufficiently covered when the pin 110 is coupled to the dielectric block 130. The cover leg 136 prevents an electrical short between the pin 110 and body 150 when the pin 110 coupled to the dielectric block 130 is coupled to the body 150. Further, the cover leg 136 is useful for the impedance matching of the coaxial connector and prevents the electrical short between the pin 110 and ground line of the coaxial cable.

In an embodiment of the present invention, the dielectric body 132 has shoulder portions 132A and 132B that forms a space 133 of 'ㄷ' shape in general. The shoulder portions 132A and 132B are formed in the dielectric body 132 at opposite side where the cylindrical portion 134 and the cover leg 136 are connected to the body 132, and the space is formed between the two shoulders 132A and 132B. Because the space 133 is formed between the shoulder portions, an operator can solder the central conductor of the coaxial cable to the soldering section 112 of the pin 110 even after the pin 110 is inserted into the through hole 138 of the dielectric block 130. In other words, the space 133 provides space to the operator for the soldering operation. The dimension of the space 133 should be enough for the soldering operation and may be e.g., 1 mm to 2 mm.

Figure 1:
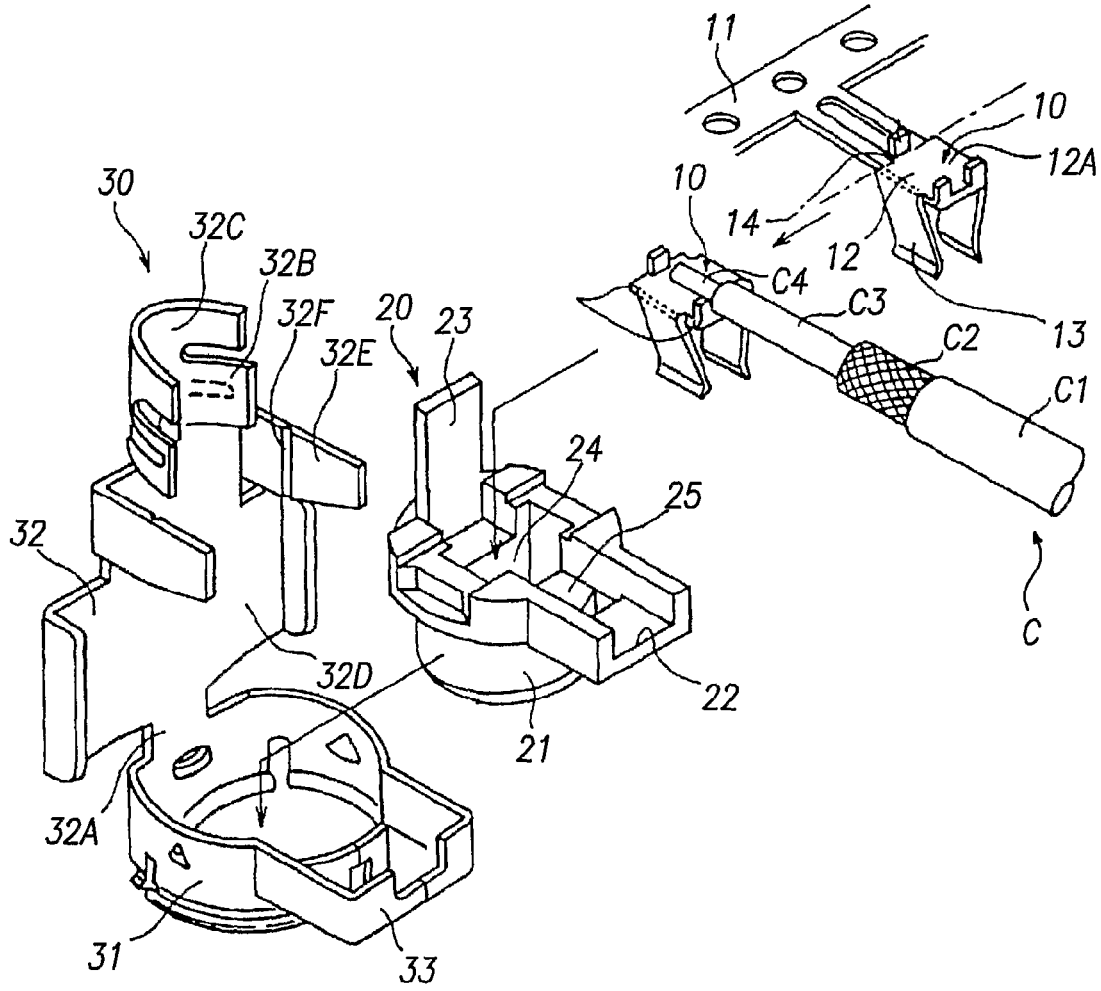
FIG. 1 PRIOR ART
FIG. 1 is a perspective view for illustrating conventional coaxial connector and manufacturing method thereof.
Figure 4A:
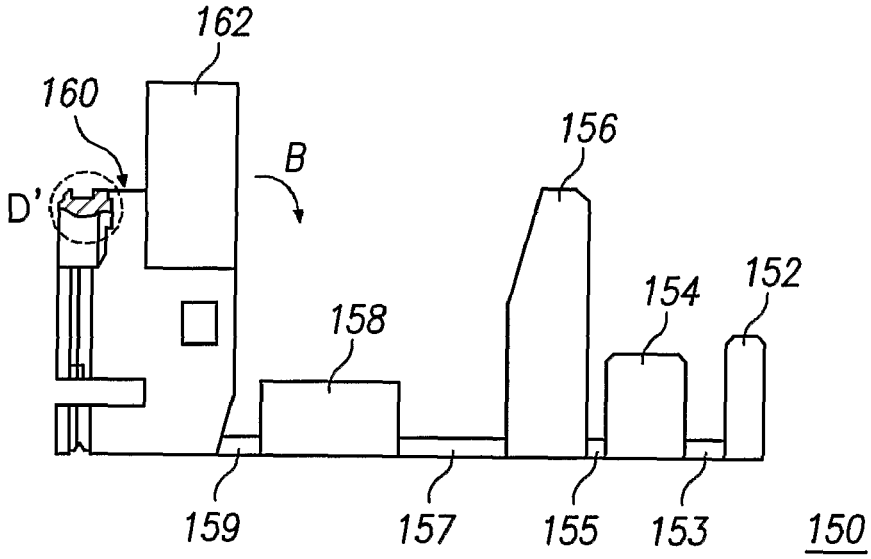
FIGS. 4A to 4C are front view, side view, and upper side view of a main body that is suitable for use in the coaxial connector of the first embodiment of the present invention, respectively.
Figure 4B:
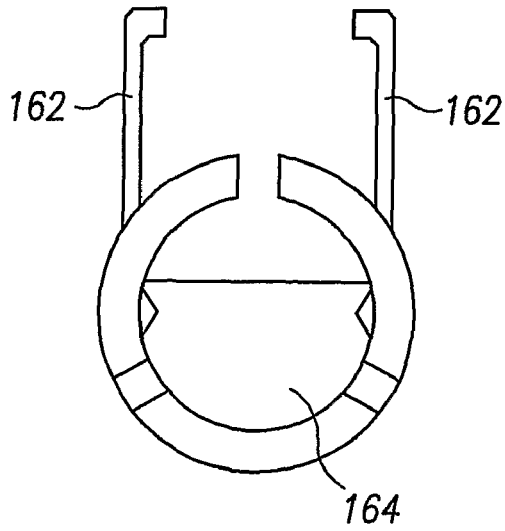
Figure 4C:
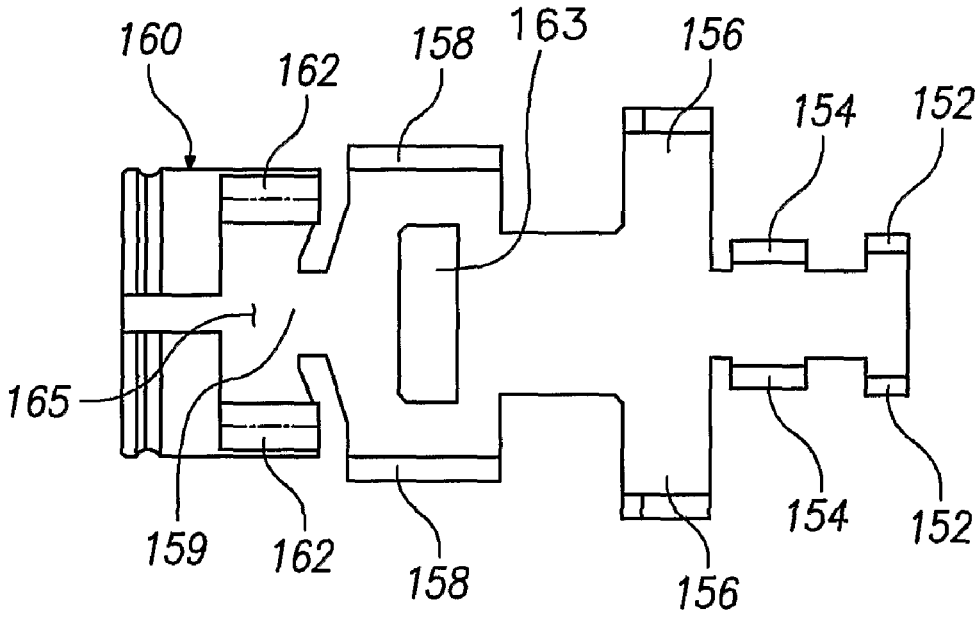

FIGS. 4A to 4C shows the body 150 for use in the coaxial connector of the present invention. The body 150 corresponds to the outer conductor 30 of the conventional coaxial connector shown in FIG. 1. The body 150, like the pin 110, may be made of an alloy such as phosphorous bronze and beryllium-copper (Be—Cu).

Referring to FIGS. 4A to 4C, the body 150 includes first, second, third and fourth fastening flaps 152, 154, 156 and 158, and a cylindrical portion 160. As shown in FIG. 4C, the body 150 has symmetrical structure. Between the first and second fastening flaps 152 and 154 is formed a first base 153, between the second and third fastening flaps 154 and 156 is formed a second base 155, and between the third and fourth fastening flaps 156 and 158 is formed a third base 157. In an embodiment of the present invention, the length of the third base 157 should be large for the soldering operation of the pin 110 with the coaxial cable when the pin 110 is coupled with the dielectric block 130 and the body 150. When the first and second bases 153 and 155 are made longer, a gap is produced between the fastening flaps for attaching the coaxial cable in the structure of the first embodiment. Therefore, in this embodiment, the third base 157 is made to have the longest length. However, the present invention is not limited to this structure and the ordinary skilled in the art may understand that the length of the first to third bases can be adjusted according to the structure of the fastening flaps of the main body in consideration of the sufficient space for the soldering operation.

In the cylindrical portion 160 of the main body 150 is formed a hole 164 for inserting the dielectric block 130 to which the pin 110 is inserted. Further, in the cylindrical portion 160 of the main body 150 has two-fold fastening flaps 162 extending in parallel to a single direction from the body 160. After the dielectric block 130 is coupled to the cylindrical portion 160, the cylindrical portion 160 is bent by 90 degrees with reference to a tab 159 to direction B as shown in FIG. 4A. By bending the cylindrical portion 160, the ends of the fold fastening flaps 162 reach to the second fastening flap 154, and then the coaxial cable is inserted into the body and the fastening flaps 152 154, 156 and 158 are bent so that the two fold fastening flaps 162 are firmly hold by the second and third fastening flaps 154 and 156. By doing this, the 90 degrees bent cylindrical portion 160 does not move and is firmly fixed. In the meantime, a space 165 is formed between the two fold fastening flaps 162 when viewed by laying down the body 160 as shown in FIG. 4C (i.e., before bending the cylindrical portion 160 along A direction of FIG. 4A). The space 165 provides space for inserting a coaxial cable when the dielectric block 130 and pin 110 are coupled to the main body 150 and then the cylindrical portion 160 is bent toward A direction of FIG. 4A. Further, the space 165 between the fold fastening flaps 162 provides a space for soldering of the central conductor 178 of the coaxial cable 170 to the soldering section 112 of the pin 110 even after the components are assembled.

Figure 4D:
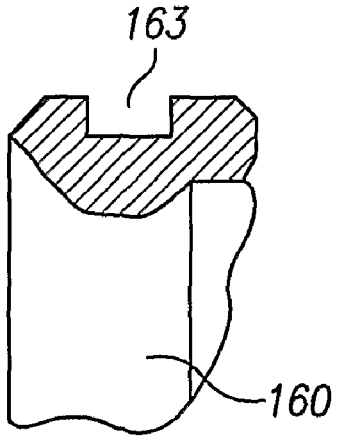
FIG. 4D is an enlarged view of 'D' in FIG. 4A.

FIG. 4D is an enlarged view of 'D' in FIG. 4A. The concaved portion 163 as shown in FIG. 4D functions a latch and improves the coupling of the coaxial connector with external devices (e.g., a male connector). When the male connector is coupled to the coaxial connector, the concaved portion 163 produces a clicking sound.

Figure 5:
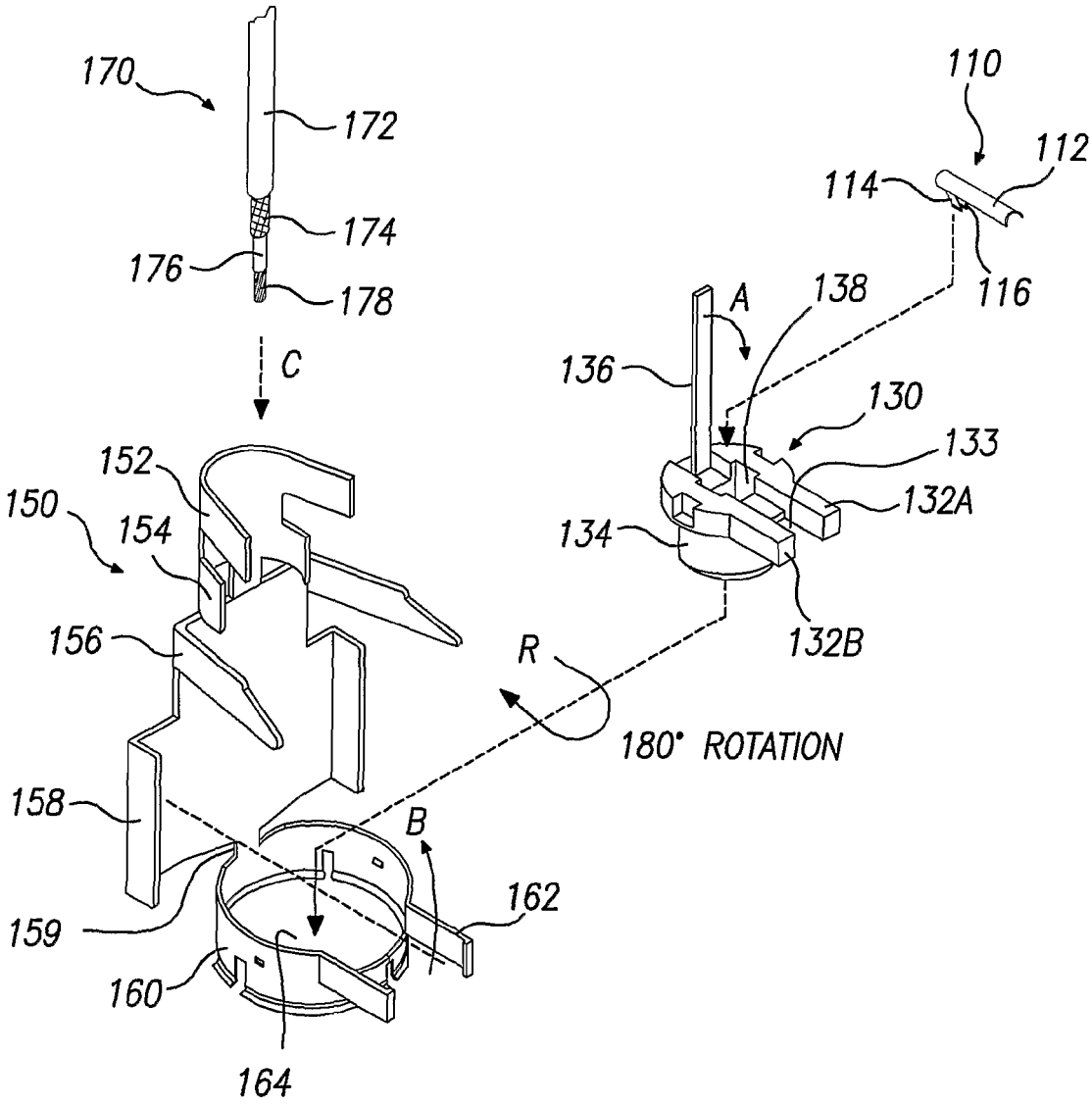
FIG. 5 is a perspective view for illustrating the process for assembling the pin, dielectric block and main body according to the first embodiment of the present invention to form the coaxial connector.

FIG. 5 is a perspective view for illustrating the assembly process of the coaxial connector according to the present invention.

Referring to FIG. 5, the contact sections 114 and 116 are inserted to the through hole 138 of the dielectric block 130 to couple the pin 110 to the dielectric block 130, and the cover leg 136 is bent along the direction A. Then the dielectric block is rotated by 180 degrees along the direction R as shown in FIG. 5, and inserted into the hole 164 of the cylindrical portion 160 of the main body 150 to fasten the dielectric block 130 to the main body 150. The cylindrical portion 160 is bent by 90 degrees along the direction B with reference to the tab 159, and then the coaxial cable 170 is inserted into the main body 150.

The coaxial cable 170 includes a jacket 172, a ground conductor 174 (or shield wire), dielectric member 176, and a central conductor 178. As explained above with reference to FIG. 4C, the central conductor 178 of the cable can reach to the soldering section 112 of the pin 110 by passing through the space 165 between fold fastening flaps 162 of the main body 150. The central conductor 178 of the cable lying on the soldering section 112 of the pin 110 is exposed through the space 165 in the cylindrical portion 165 and the space 133 in the dielectric block 130, and thus the soldering operation to the central conductor 178 to the soldering section 112 can be done. Then, the first to fourth fastening flaps 152 to 158 of the main body 150 are bent to interconnect the ground conductor 174 of the cable 179 to the main body 150 and to press and hold the jacket 172.

Figure 6A:
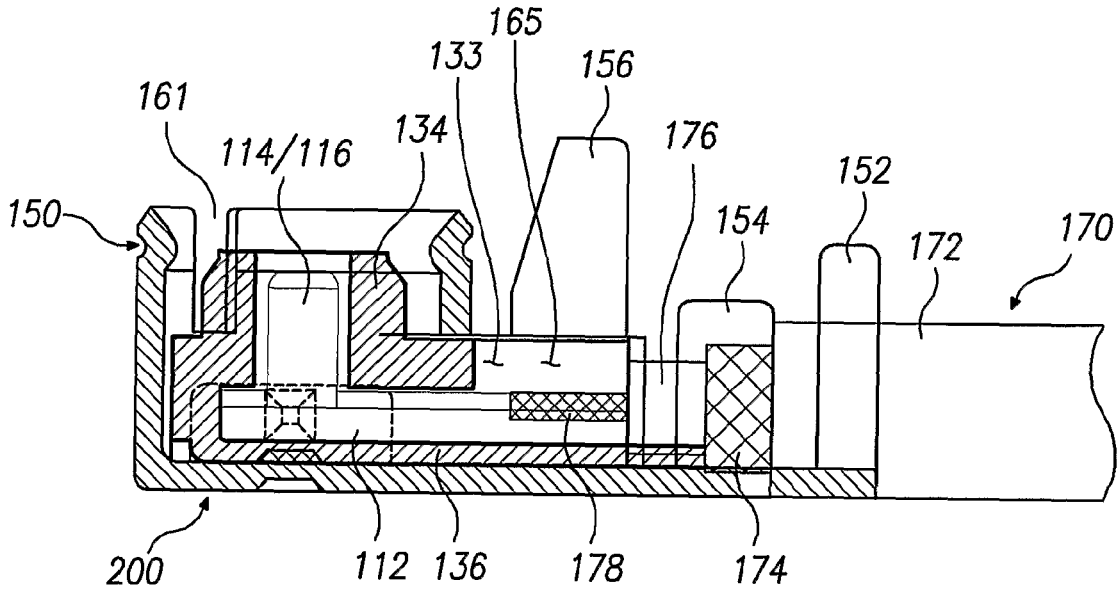
FIGS. 6A and 6B are cross sectional views of the coaxial connector in which the pin, dielectric block and main body shown in FIGS. 2 to 4 are coupled with a coaxial cable.
Figure 6B:
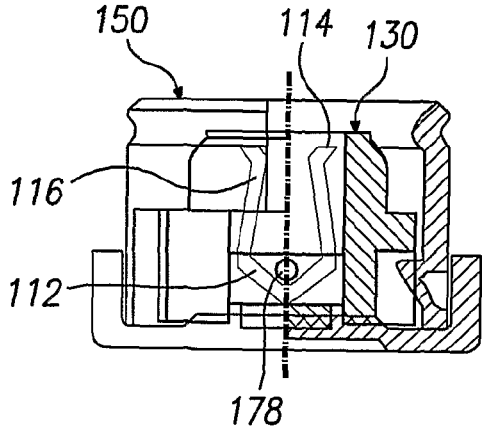

The structure of the coaxial connector 200 obtained by assembling the components (pin, dielectric block and main body) and the connection structure of the connector 200 to the coaxial cable 170 are easily understandable by referencing to FIGS. 6A and 6B. In other embodiment of the present invention, liquid and electrical insulating epoxy may fill both the space 133 in the body 132 of the dielectric block 130 and the space 165 between the fold fastening flaps 162 of the main body 150. The liquid epoxy has to be filled after the pin 110 is soldered to the central conductor 178 of the cable 170. For the liquid epoxy, epoxy material having dielectric constant ranging from 4 to 10. The epoxy filling the spaces 133 and 165 can prevent the electrical short between the central conductor 178 and other conductor where the ground potential is applied, and prevent the degradation of electrical characteristics of the connector, which may occur from the spaces in the body.

Figure 7:
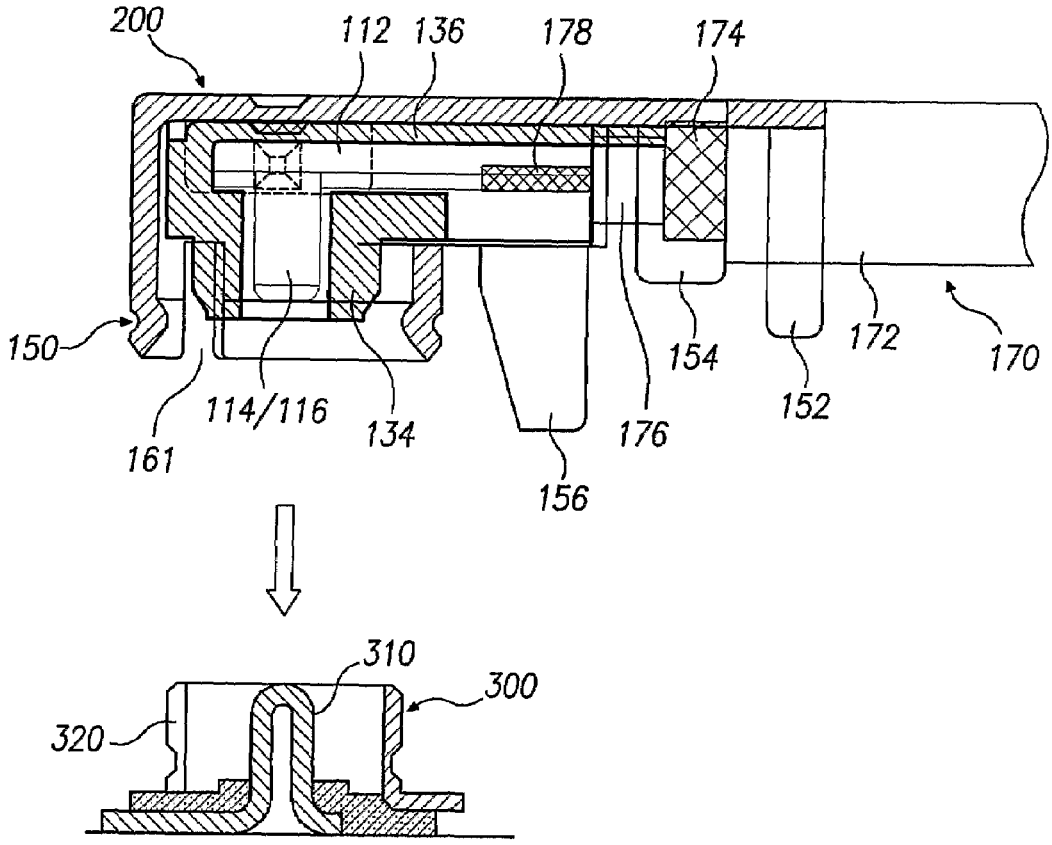
FIG. 7 is a perspective view for showing the connection structure of the coaxial connector of the first embodiment of the present invention to a male connector.

FIG. 7 is a perspective view for illustrating a connection structure of the coaxial connector 200 to a male connector 300. The male connector 300 includes a terminal 310 and a ground conductor 320, and connection structure of the coaxial connector 200, coaxial cable 170 and the male connector 300 is as follows.

Signal: Central conductor 178 of the coaxial cable 170→Soldered portion→Soldering sections 112 of the pin→Contact sections 114 and 116→Terminal 310 of the male connector 300.

Ground: Ground conductor 174 of the coaxial cable 170→Main body 150→Ground conductor 320 of the male connector.

Figure 8:
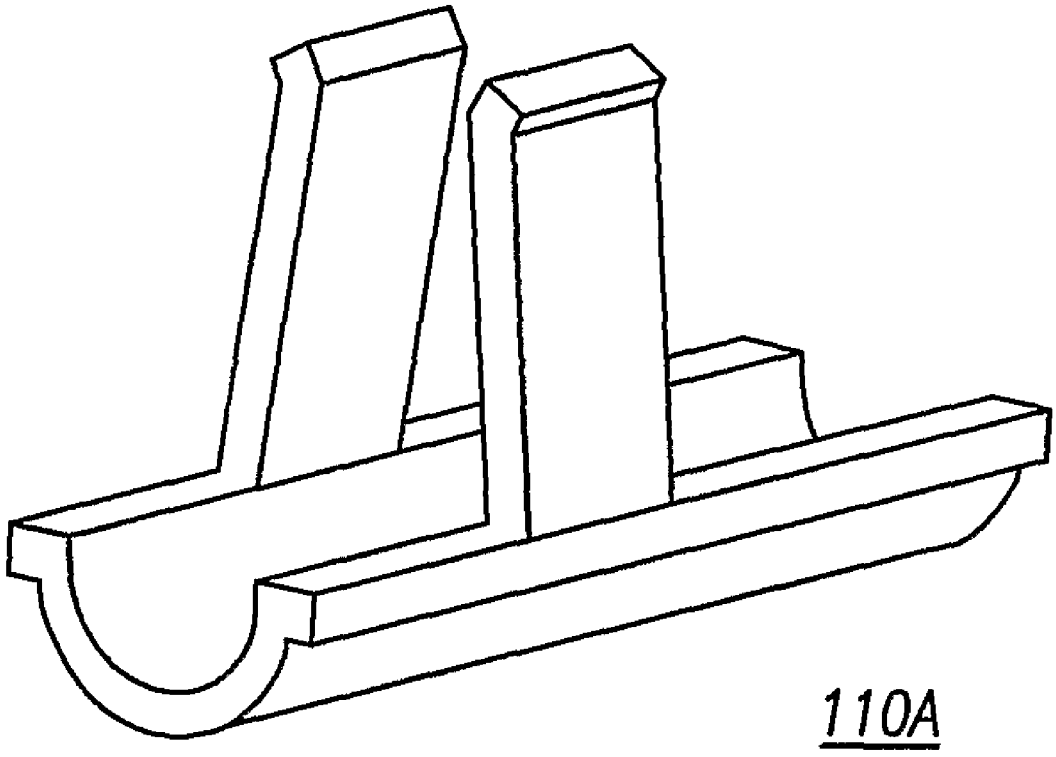
FIG. 8 is a perspective view of a pin of U-shaped structure, which can be used in the coaxial connector of the first embodiment of the present invention.

The coaxial connector of the first embodiment as explained above can be modified without departing the sprit and scope of the present invention. For instance, the pin 110 shown in FIG. 2 as has a cross section of V-shape. However, other pin structure 110*a* having U-shaped cross section as shown in FIG. 8 can be applied to the present invention.

Second Embodiment

With reference to FIGS. 9 to 11, second embodiment of the present invention will be explained in detail.

The second embodiment of the present invention, like the first embodiment, enables the soldering operation of the coaxial cable to the coaxial connector to be carried out after assembling the components for the coaxial connector. The coaxial connector according to the second embodiment has partially modified structure from the first embodiment for improving electrical characteristics of the coaxial connector. Below, the structural differences between the first and second embodiments are explained.

Pin Structure in the Second Embodiment

Figure 9A:
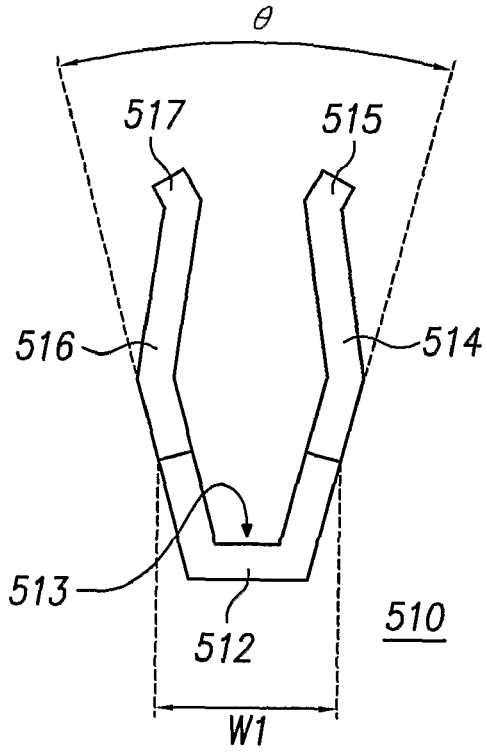
FIGS. 9A and 9B are front view and side view of a pin suitable for use in the coaxial connector of the second embodiment of the present invention, respectively.
Figure 9B:
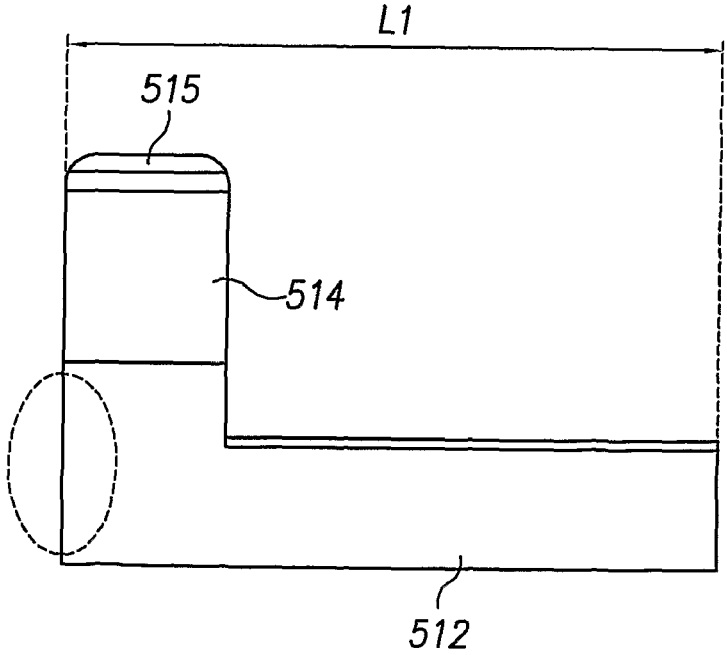

Referring to FIGS. 9A and 9B, the pin 510 suitable for use in the coaxial connector of the second embodiment, which may be made from an alloy such as phosphorous bronze and beryllium-copper (Be—Cu), has a soldering section 512 and two contact sections 514 and 516 extending upwardly from the soldering section 512.

Comparing with the structure in the first embodiment, the pin 512 of the second embodiment has following structural differences.

(1) The bottom surface of the soldering section 512 is flat, unlike the V- or U-shaped structure of the pin 112 of the first embodiment. To the groove 513 formed by the contact sections 514 and 516 is soldered the central conductor ('178' of FIG. 5) of the coaxial cable 170. The flat structure of the soldering section 512 is due to the fact that the width of the soldering section 512 is smaller than the width of the soldering section 112 and thus bending process to the narrow soldering section 512 is difficult. If the bending operation is possible, the flat structure may be changed to the V- or U-shaped structure.

(2) The soldering section 512 of the second embodiment has narrower width than the soldering section 112 of the first embodiment. That is, the width 'w1' of the soldering section 512 as shown in FIG. 9A is smaller than the width of the soldering section 112 of the first embodiment. For example, the soldering section 112 has a width of 0.8 mm, and the width w1 of the soldering section 512 of the second embodiment is equal to or less than 0.62 mm. Further, the length ('L1' in FIG. 9*b*) of the soldering section 512 of the second embodiment is smaller than that of the first embodiment. For instance, the soldering section 512 has a length of 2.2 mm compared to 2.9 mm in the first embodiment. When the width w1 of the soldering section 512 is reduced, the capacitance between the signal lines and grounds is decreased, which results in an increase of impedance. Likewise, the smaller length L1 of the soldering section 512 results in an increase of impedance.

(3) The connection structure of the central conductor of coaxial cable and the terminal (or central connection portion) of the male connector is not different between the first and second embodiment in that the first and second contact sections 514 and 516 of the pin 510 according to the second embodiment are electrically interconnected to the external male connector. However, as shown in FIG. 9A, the first and second contact sections 514 and 516 do not extend upwardly and straightly from the soldering section 512 and has bent structure. More specifically, the contact sections 514 and 516 extend from the soldering section 512 outwardly first and in middle portion extend inwardly. With the bent structure of the contact sections 514 and 516, tension and coupling strength between the central pin ('852' of FIGS. 16A to 16C) of the male connector and the contact sections 514 and 516 are improved. The purposes of the structure of ends 515 and 517 of the contact sections 514 and 516 are identical as in the structures 115 and 117 of the first embodiment.

(4) The pin 510 of the second embodiment has an end surface that is coincide with the end surfaces of the contact sections 514 and 516 as shown by a dotted circle in FIG. 9B. In contrast, the end surface of the soldering section 112 of the first embodiment protrudes from the end surfaces of the contact sections 114 and 116 in the first embodiment. With the end surface of the pin 510 as shown in FIG. 9B, the capacitance between the signal lines and grounds is decreased and thus the impedance is increased.

Dielectric Block in the Second Embodiment

Referring to FIGS. 10A to 10E, dielectric block 530 of the second embodiment includes a body 532, a cylindrical portion 534 and a cover leg 536. The structural differences of the dielectric block of the second embodiment from the first embodiment are as follows.

Figure 10A:
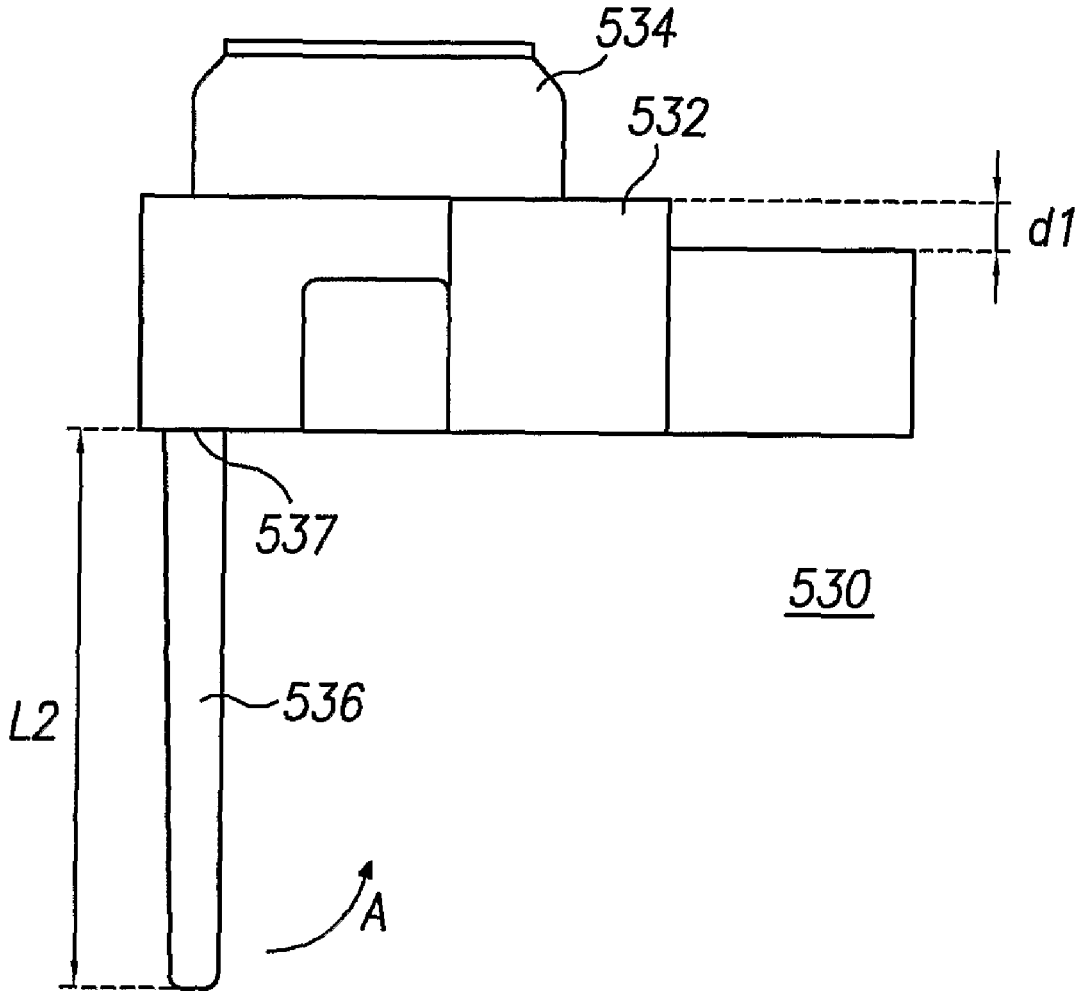
FIGS. 10A to 10E are front view, side view, upper side view, bottom side view and cross section view of dielectric block suitable for use in the coaxial connector of the second embodiment of the present invention.
Figure 10B:
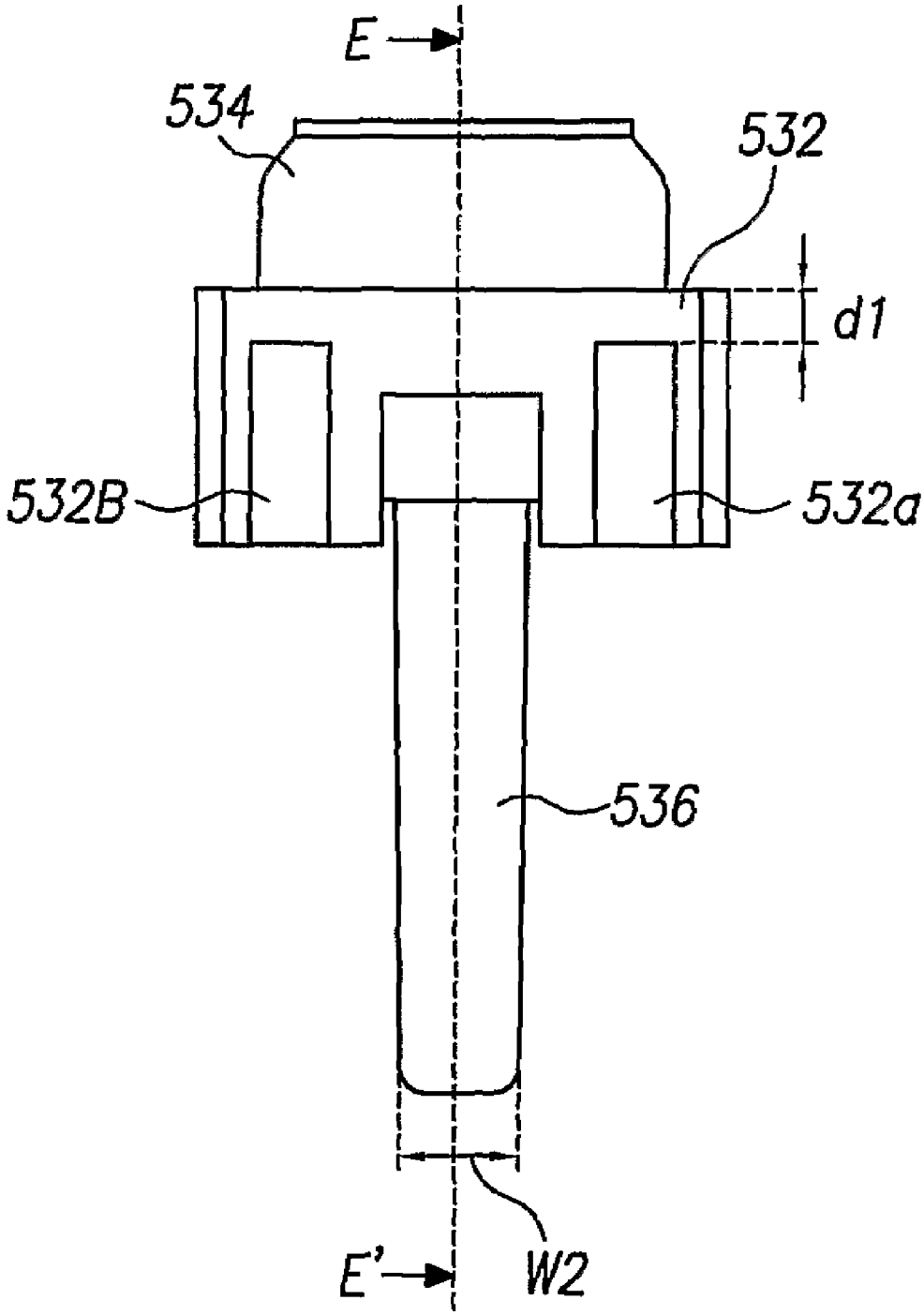
Figure 10C:
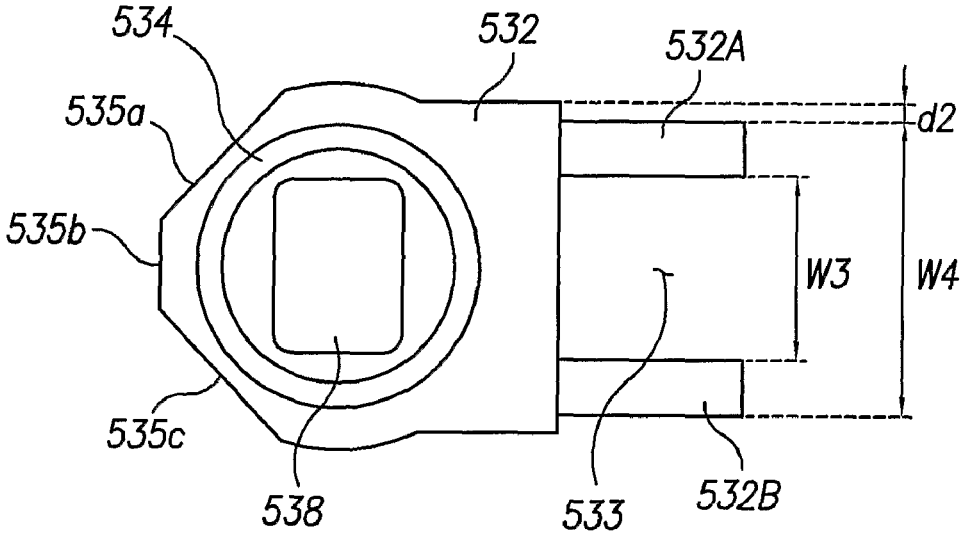
Figure 10D:
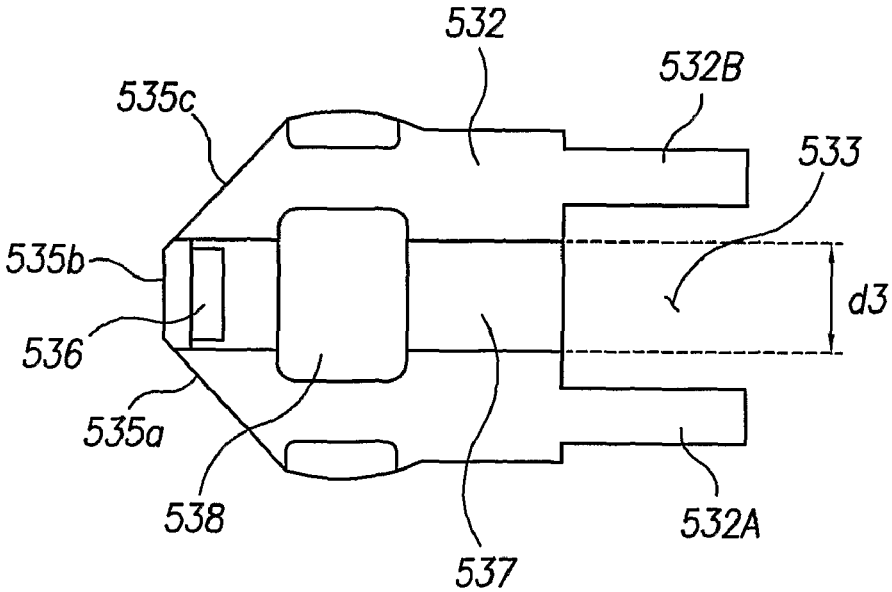
Figure 10E:
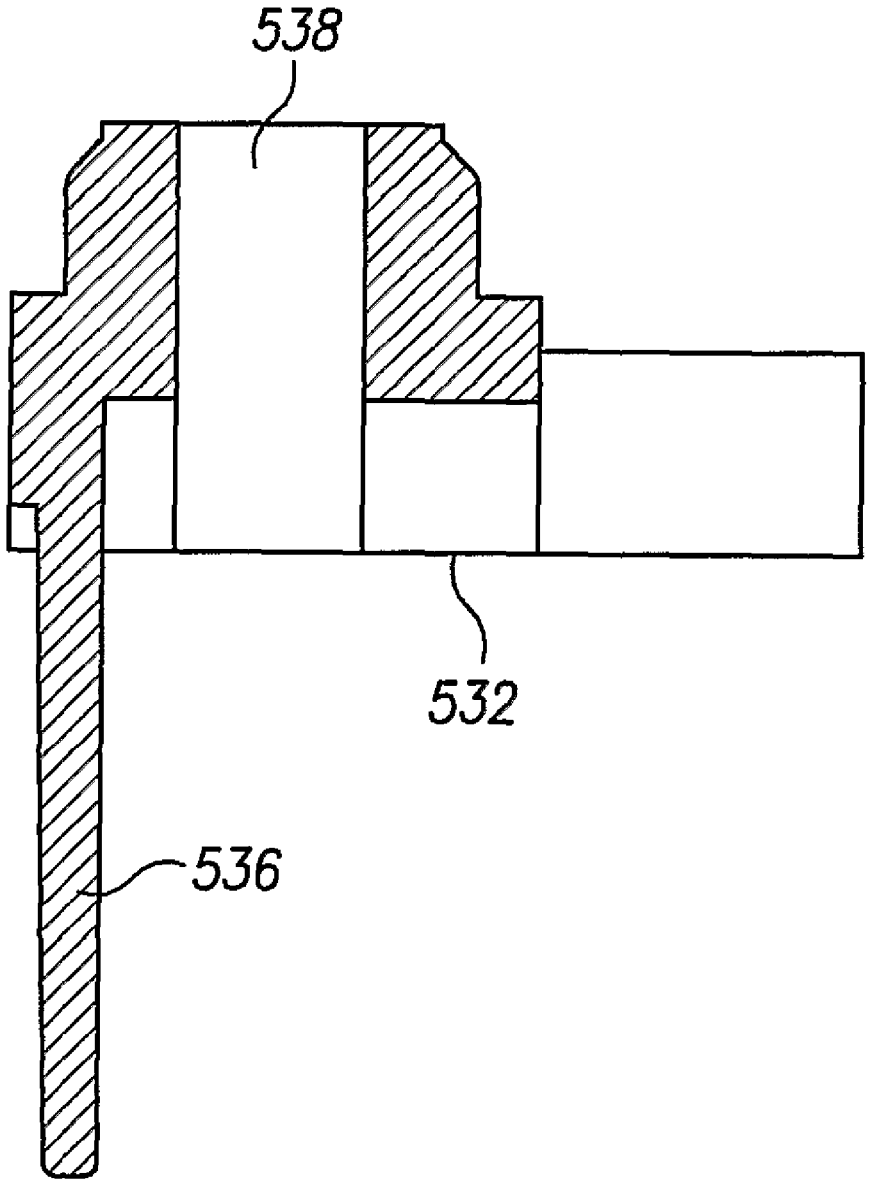

(1) The body 532 of the dielectric block 530 has a chamfered structure in the second embodiment. As shown in FIGS. 10C and 10D, the body 532 has a first straight line portion 535*b* at the end of the body, and second and third straight line portions 535*a* and 535*c* symmetrically disposed at both sides of the first straight line portion 535*b*. With the chamfered structure of the body 532, the area that the body 532 occupies is made to be minimized, and the reduced area of the dielectric may compensate the reduced impedance. The rounded structure of the body 132 of the first embodiment is modified to the chamfered structure in the second embodiment, which corresponds to transforming some parts of the rounded body 132 into air in the chamfered structure 532 and therefore the dielectric constant of those parts is reduced from e.g., 2.1 (dielectric constant of the dielectric body) to 1.0 (dielectric constant of air) to make the overall impedance to increase.

(2) Length L2 and width w2 of the cover leg 536 are reduced in the second embodiment. This is related to the structural modification of the pin 510 (i.e., the reduction of length and width of the pin) as explained above.

(3) Width w3 of space 533 is reduced. The space 533 is formed by shoulder portions 532A and 532B protruding from the body 532, and the space is made smaller by reducing the width w3 between two shoulder portions 532A and 532B.

(4) Width w4 of the shoulder portions 532A and 532B is reduced to decrease the width of a clamping portion. Reducing the width of clamping portion is possible by making the shoulder portions 532A and 532B to protrude from the point that locates slightly inwardly from the end of the body 532 (i.e., the point distant from the end of the body 532 by a distance 'd2') as shown in FIG. 10C. Therefore, when comparing with the dielectric block 130 of the first embodiment, the dielectric block 530 of the second embodiment comprises an air dielectric added by the distance d2.

(5) Height of the shoulder portions 532A and 532B is reduced by d1. That is, as shown in FIGS. 10A and 10B, the height of shoulder portions 532A and 532B is lower than the body 532. This is to add the air dielectric by the distance d1 to the dielectric block like the addition of air dielectric as explained above (4). The reduction of the height of shoulder portions is optional.

(6) Like the first embodiment, in the cylindrical portion 534 of the dielectric block 530 is formed a through hole 538, and the contact sections 514 and 516 of the pin 510 are inserted into the through hole 538. At this time, the soldering section 512 perpendicularly connected to the contact sections 514 and 516 is fixed to the clamping portion 537 of the body 532 as shown in FIG. 10D. In the second embodiment, the dimension d3 of the clamping portion 537 is reduced.

Main Body in the Second Embodiment

Figure 11A:
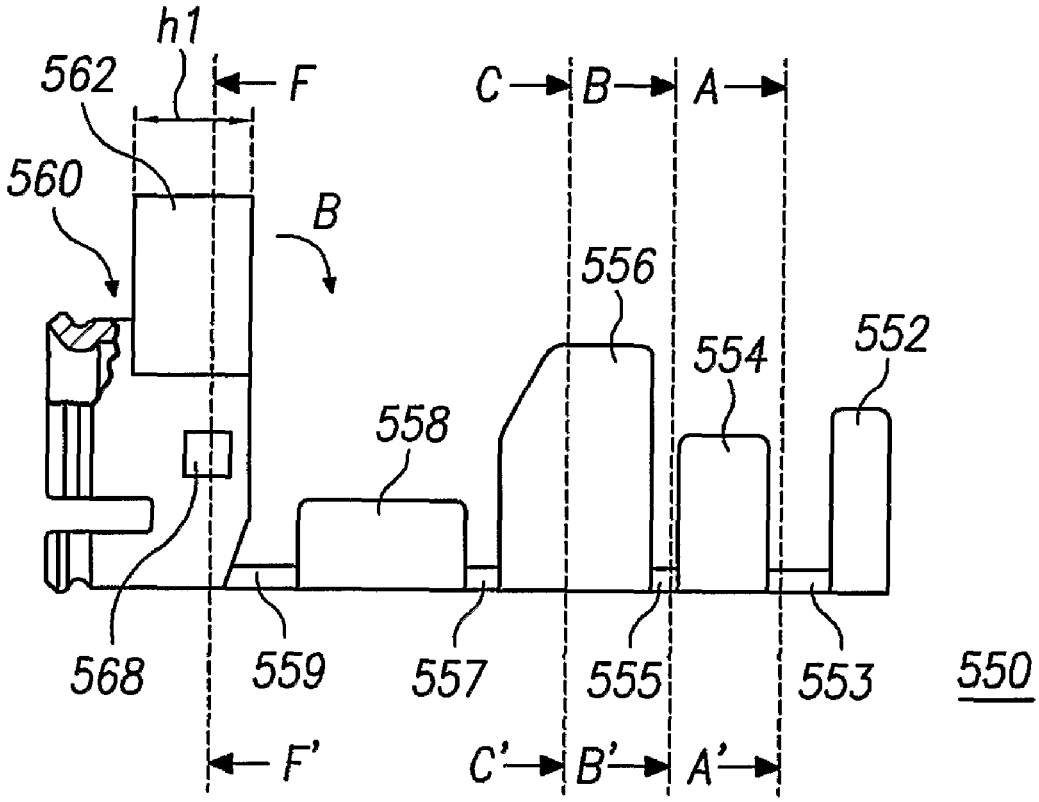
FIGS. 11A to 11C are front view, side view and upper side view of main body suitable for use in the coaxial connector of the second embodiment of the present invention, respectively.
Figure 11B:
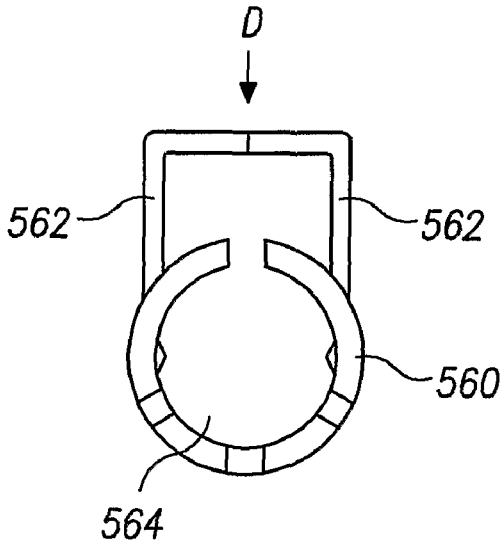
Figure 11C:
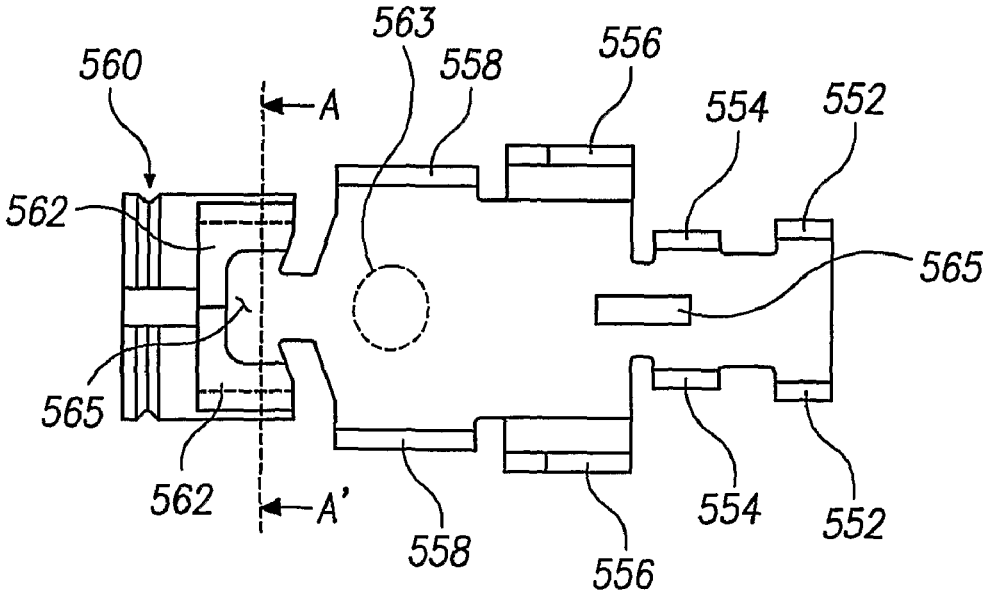
Figure 11D:
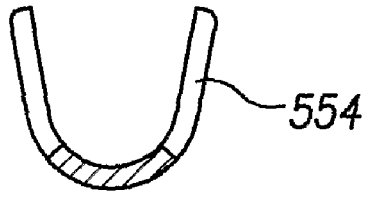
FIGS. 11D to 11F are cross sectional views of the main body shown in FIG. 11A along lines A-A', B-B', and C-C', respectively.
Figure 11E:
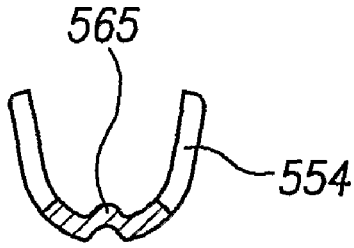
Figure 11F:
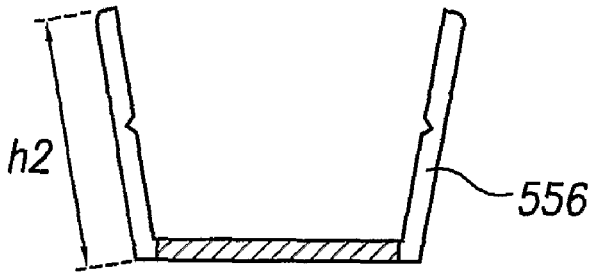
Figure 11G:
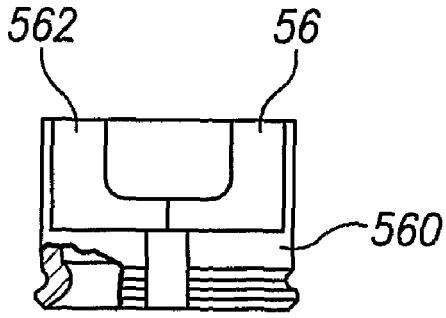
FIG. 11G is a front view of 11B when viewed from the direction 'D'.
Figure 11H:
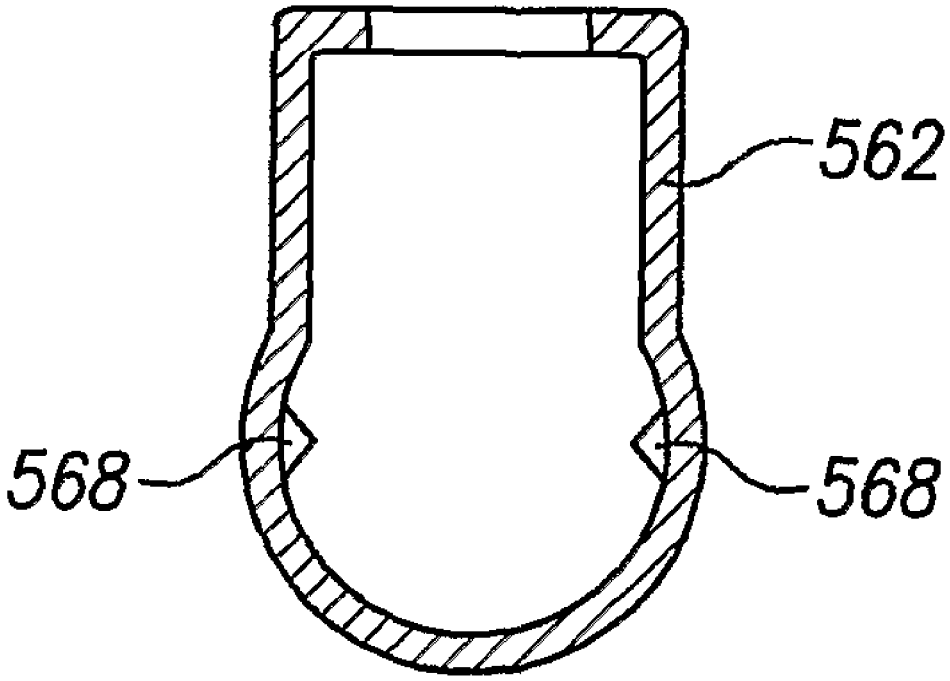
FIG. 11H is a cross sectional view of FIG. 11A along the line F-F'.
Figure 12A:
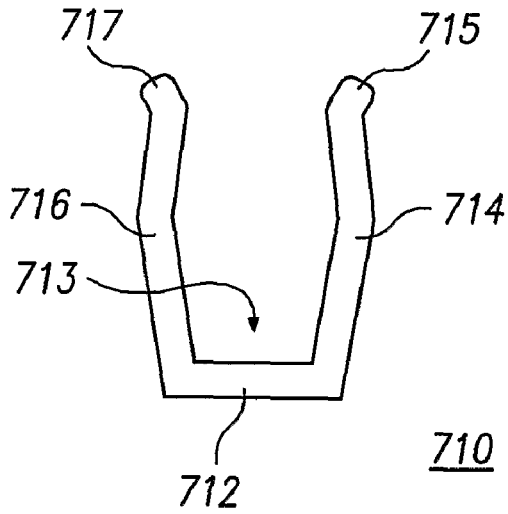
FIGS. 12A to 12D are front view, top side view, right side view and left side view of a pin suitable for use in the coaxial connector of the third embodiment of the present invention, respectively.
Figure 12B:
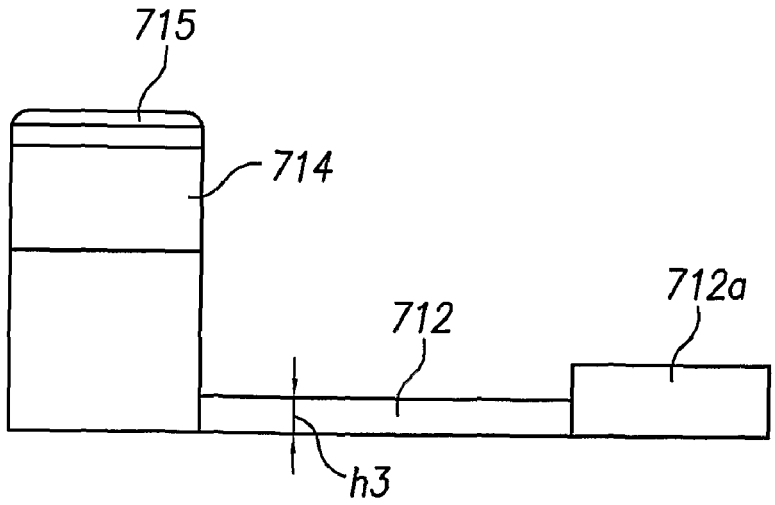
Figure 12C:
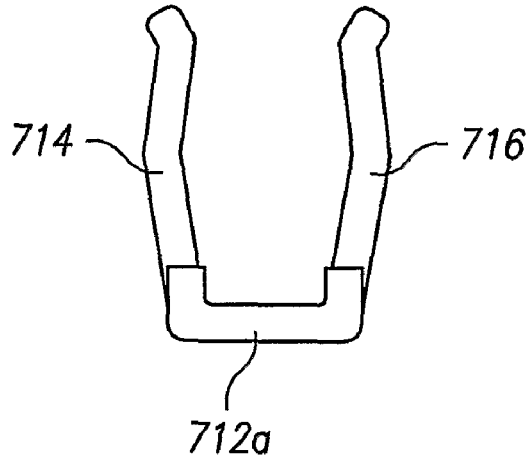
Figure 12D:
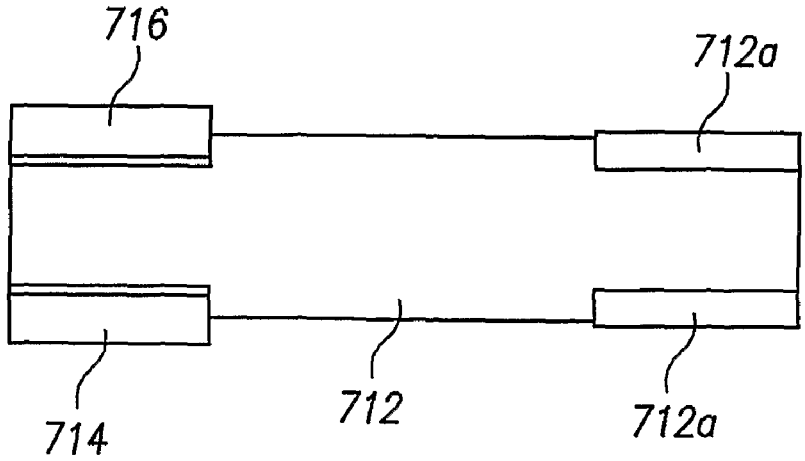

Main body 550 of the second embodiment may be made from an alloy such as phosphorus bronze and beryllium-copper like the pin 510, and includes a cylindrical portion 560 and first to fourth fastening flaps 552, 554, 556 and 559 for fixing the cylindrical portion 560 and the coaxial cable. First to fourth bases 553, 555, 557 and 559 are formed between the first to fourth fastening flaps, respectively. When comparing with the main body 150 of the first embodiment, the main body 550 of the second embodiment is different in structure in that:

(1) Fold fastening flaps 562 of the cylindrical portion 560 bite each other to form a closed structure as shown in FIGS. 11B and 11H. With the closed structure of the fold fastening flaps 562, the dielectric block 530 can be hold more firmly in the space 564 of the cylindrical portion 560. Because the size of the dielectric block 530 is made smaller in the second embodiment, it is required to hold more firmly the dielectric block 530 inserted into the cylindrical portion 560. It should be noted that the closed structure of the fold fastening flaps 562 has to provide a space 565 between the fastening flaps 562 by e.g., forming an arched structure. This space 565 may provide space for inserting the coaxial cable when the dielectric block 530 and pin 510 are coupled to the main body 550 and the cylindrical portion 560 is bent.

(2) In the second embodiment, an embossment in the main body 550 has to be removed. In other words, there is no embossment in the body surface between the fourth fastening flaps 558 and the body surface is flat as shown in FIG. 11C. In contrast, the main body 150 of the first embodiment has embossed portion 163 as shown in FIG. 4C. The embossed portion 163 has a reversed U-shape and the distance between the pin 110, which is inserted into the dielectric block 130 and lies on the embossed portion 163, and the ground (i.e., surface of main body 150) is made smaller. By removing the embossed portion in the main body 550 of the second embodiment, the distance between the pin 510 and the ground surface is increased, which results in a reduction of capacitance and compensation of impedance.

(3) Rectangular embossed portion 565 is formed across both the space between the second fastening flaps 554 and the space between the third fastening flaps 556 as shown in FIG. 11C. The rectangular embossed portion 565 is for preventing the surface of body 550 from bending and for making the body 550 more adamant. The shape of the embossed portion 565 is not limited to the rectangular shape. The rectangular embossed portion 565 protrudes upwardly as shown in FIG. 11E.

(4) Height h1 of insertion portion of the cylindrical portion 560 into which the dielectric block 530 is increased to compensate the impedance.

(5) Height h2 of the third fastening flaps 556 is increased as shown in FIG. 11F. The increase of the height h2 is due to the increased height h1 of the insertion portion of the cylindrical portion 560. Projection 568 is formed on inner wall of the cylindrical portion as shown in FIGS. 11A and 11H for the dielectric block 530 inserted into the space 564 of the cylindrical portion 560 to be hold more firmly.

Third Embodiment

With reference to FIGS. 12 to 14, the third embodiment of the present invention will be explained. Among others, the technical features of the third embodiment include the reduction of overall height of structure obtained by coupling the coaxial connector to a male connector. For instance, the height of the coupled structure is 2.4 mm, while the height in the third embodiment is reduced to 1.8 mm. When the height of the coaxial connector is reduced, it is advantageous to be applied to small electronic devices. For example, cellular phones employ integrated circuit chips that have ever decreasing chip height and thus the height of the coaxial connector should be adjusted in consideration of the reduced chip size.

The third embodiment of the present invention, like the first embodiment, enables the soldering operation of the coaxial cable to the coaxial connector to be carried out after assembling the components for the coaxial connector.

Pin in the Third Embodiment

Referring to FIGS. 12A to 12D, pin 710 of the third embodiment, like in the second embodiment, has flat bottom surface of soldering section 712, and the central conductor ('178' of FIG. 5) of the coaxial cable is soldered to a groove 713. Further, the first and second contact sections 714 and 716 are of bent structure without extending straightly from the soldering section 712 like in the second embodiment to strengthen the coupling with a pin of a male connector inserted between the contact sections. Moreover, outward bending structure of the end portions 715 and 717 of the contact sections 714 and 716 is identical to the first and second embodiments.

In the third embodiment, the two contact sections 714 and 716 are formed only in the end portion of the pin 710 when viewed from the length direction of the pin, and only the soldering section 712 having flat bottom surface extends along the length direction of the pin. Therefore, it is preferable that humps 712*a* is formed at both ends of the soldering section 712 to prevent the solder from overflowing during the soldering operation of the soldering section 712 to the central conductor of coaxial cable.

In the third embodiment, the height h3 of the soldering section 712 of pin 710 is reduced to e.g., 0.1 mm.

Dielectric Block in the Third Embodiment

Figure 13A:
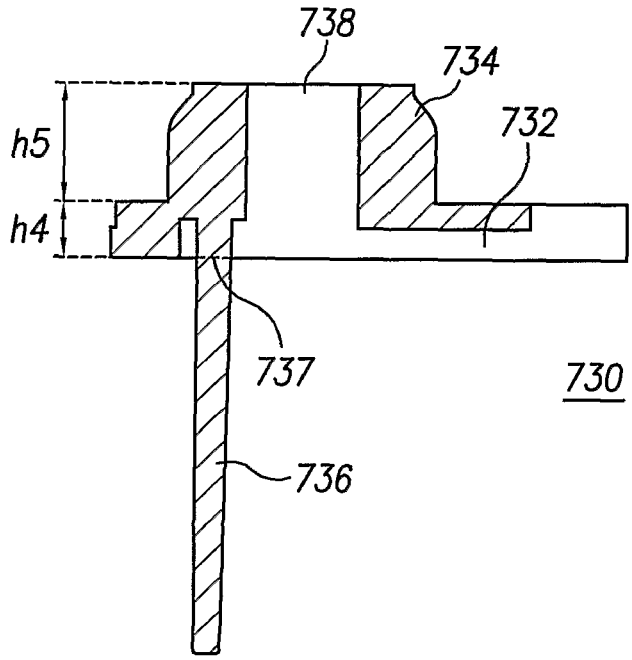
FIGS. 13A to 13C are front view, side view, and top side view of a dielectric block suitable for use in the coaxial connector of the third embodiment of the present invention, respectively.
Figure 13B:
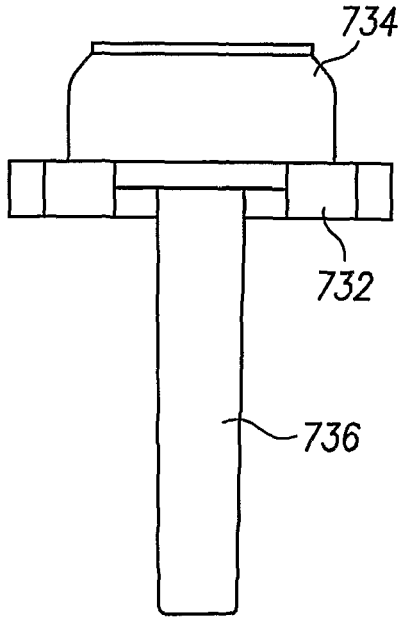
Figure 13C:
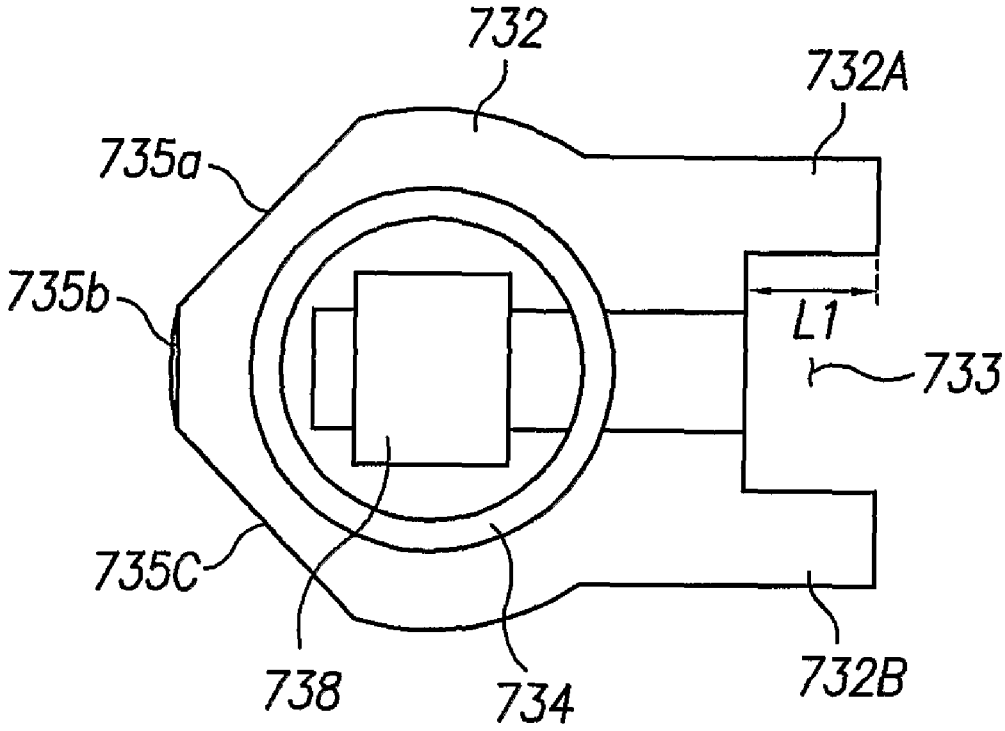

Referring to FIGS. 13A to 13C, the dielectric block 730 of the third embodiment includes body 732, cylindrical portion 734 and cover leg 736. The body 732, like the body 532 of the second embodiment, has a chamfered structure. That is, as shown in FIG. 13C, the body 732 includes the first straight line portion 735*b* and the second and third straight line portion 735*a* and 735*c* symmetrically disposed at both sides of the first straight line portion 735*b*. To through hole 738 of the cylindrical portion 734 is inserted a pin 710. The cover leg 736 is bent with reference to the connection surface 737 after the pin 710 is inserted into the through hole 738.

In the body 732 of the third embodiment, two protruding shoulder portions 732A and 732B form a space 733 for providing, like in the first and second embodiments, space for the soldering operation of the central conductor of coaxial cable to the soldering section 712 of the pin 710 after the pin 710 is inserted into the through hole 738. The length (L1 of FIG. 13C) of the shoulder portions 732A and 732B is less than those of the first and second embodiments.

The height of the dielectric block 730 is lower than those of the first and second embodiments, which can be accomplished by reducing the height denoted by 'h4' in FIG. 13A. The height 'h5' denoted in FIG. 13A is set by technical standard, and hence this height h5 cannot be reduced for coupling the coaxial connector to the external male connector.

Main Body in the Third Embodiment

Figure 14A:
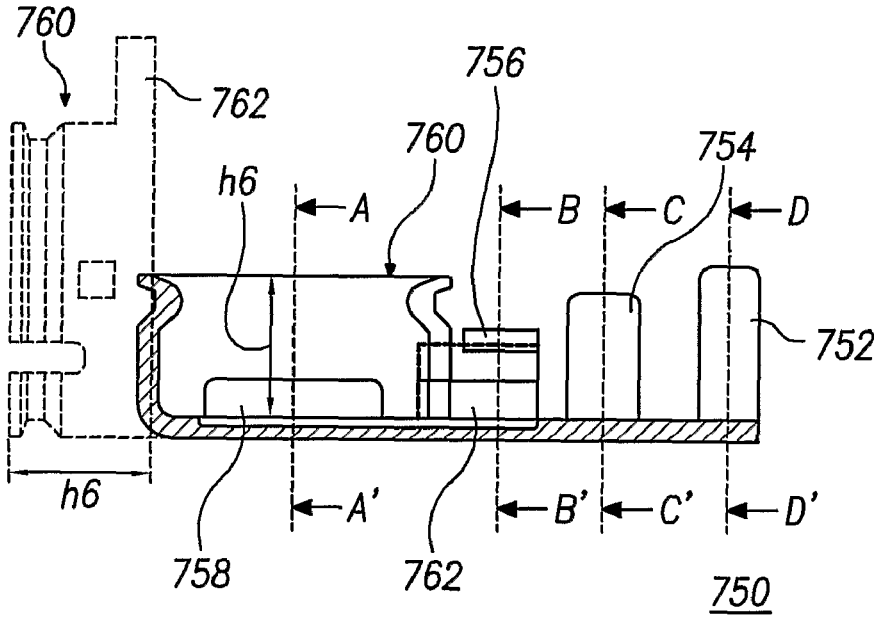
FIGS. 14A to 14C are front view, side view, and top side view of a main body suitable for use in the coaxial connector of the third embodiment of the present invention, respectively.
Figure 14B:
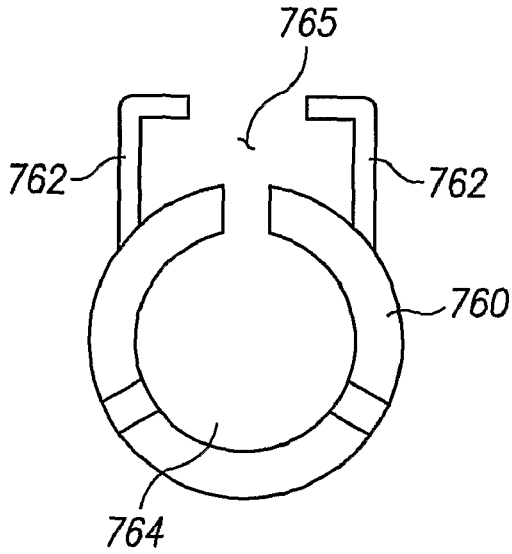
Figure 14C:
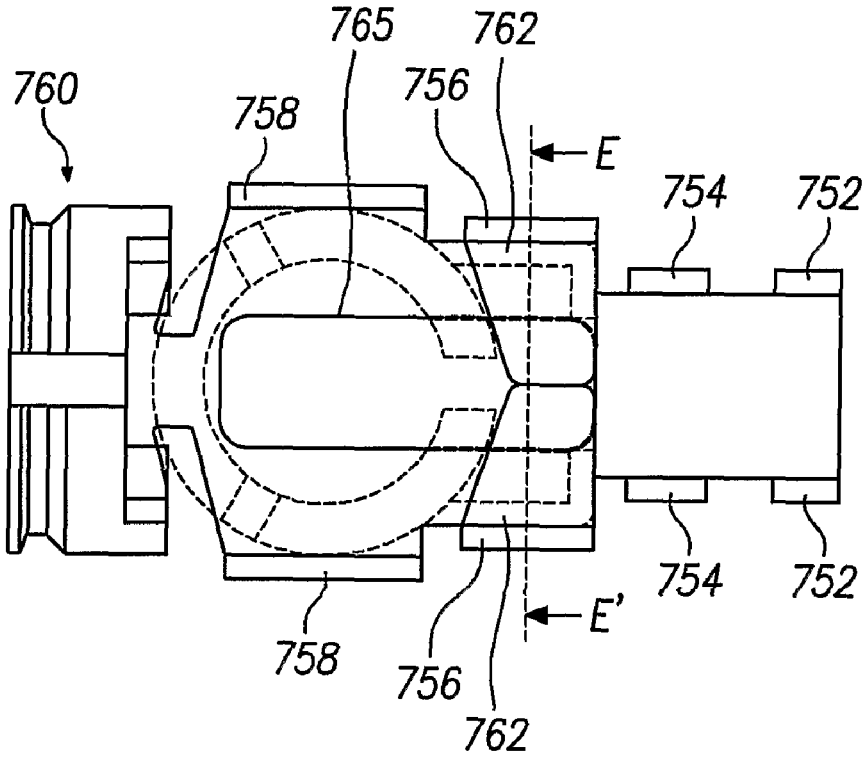

As shown in FIGS. 14A and 14B, the main body 750 of the third embodiment includes cylindrical portion 760 to which the dielectric block 730 is inserted, first to third fastening flaps 752, 754, and 756 for holding a coaxial cable, and fourth fastening flaps 758 for holding the cylindrical portion 760.

Figure 14D:
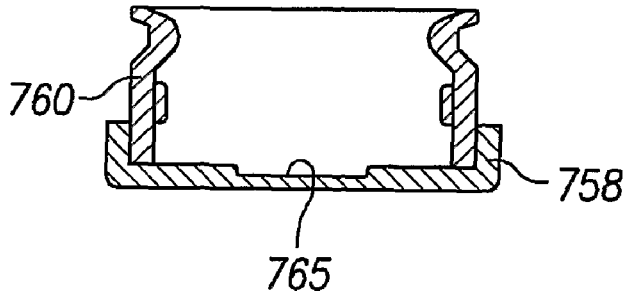
FIGS. 14D to 14G are cross sectional views of FIG. 14A along the lines A-A', B-B', C-C' and D-D', respectively.

In the main body 750 of the third embodiment, an embossed portion 765 is formed between the third and fourth fastening flaps 756 and 758. The embossed portion 765 has length and width enough to accommodate the cover leg 736. Further, the embossed portion 765 has a groove structure and a flat bottom surface as shown in FIG. 14D. By forming the embossed portion 765 in the third embodiment, the overall height of the coaxial connector is not increased, which may occur by the cover leg 736 of the dielectric block 730 when the dielectric block 730 is inserted into the cylindrical portion 760 of the main body 750 and the cylindrical portion 760 is bent. In an embodiment of the present invention, the depth of the embossed portion 765 is about 5/100 mm.

In the main body 750 of the third embodiment, the height h6 of the cylindrical portion 760 is reduced in comparison with the first and second embodiments. With the reduced height of h6, the overall height of the coupling structure of the coaxial connector and male connector can be decreased. For instance, the height h6 is less than those of first and second embodiments by about 0.6 mm.

Figure 14E:
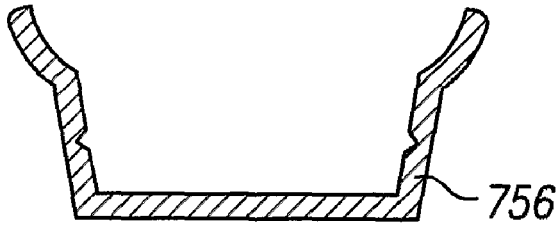
Figure 14F:
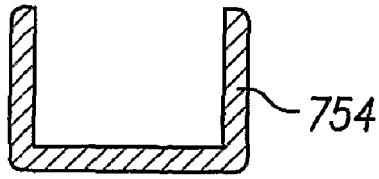
Figure 14G:
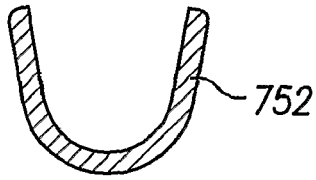
Figure 14H:
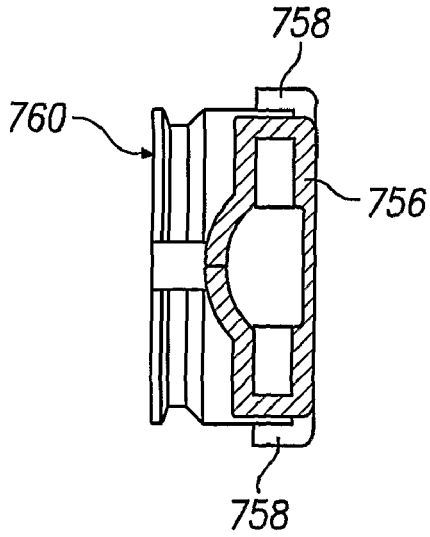
FIG. 14H is a cross sectional view of FIG. 14B along the line E-E'.

In the main body 750 of the third embodiment, the third fastening flap 756 is bent to have a circular arc shape as shown in FIG. 14E. If the third fastening flap 736 has a straight line structure, it is likely that the third fastening flap 736 contact the central conductor of coaxial cable when a coaxial cable is inserted into the main body 750 and the first to fourth fastening flaps 752 to 758 are bent. Therefore, for preventing the electrical short between the third fastening flap 736 and the central conductor of coaxial cable, the third fastening flaps 736 having the circular arc shape provide a space when it is bent for passing the central conductor of coaxial cable. The dimension of the circular arc of the third fastening flap 736 is determined by considering the prevention of the electrical short and enough to prevent the circular arc from being pressed by coupling force of a male connector to the coaxial connector.

Male Connector

With reference to FIGS. 15 and 16, the structure of male connector suitable for coupling to the coaxial connector of the present invention is explained. The male connector includes a metal shell 820 as shown in FIG. 15 and a central contact 850 as shown in FIG. 16. The metal shell 820 of FIG. 15 corresponds to the ground conductor 320 of FIG. 7, and the central contact 850 of FIG. 16 corresponds to the terminal 310 of FIG. 7. The assembled structure of the metal shell 820 and the central contact 850 is held by an insulating housing (not shown).

Figure 15A:
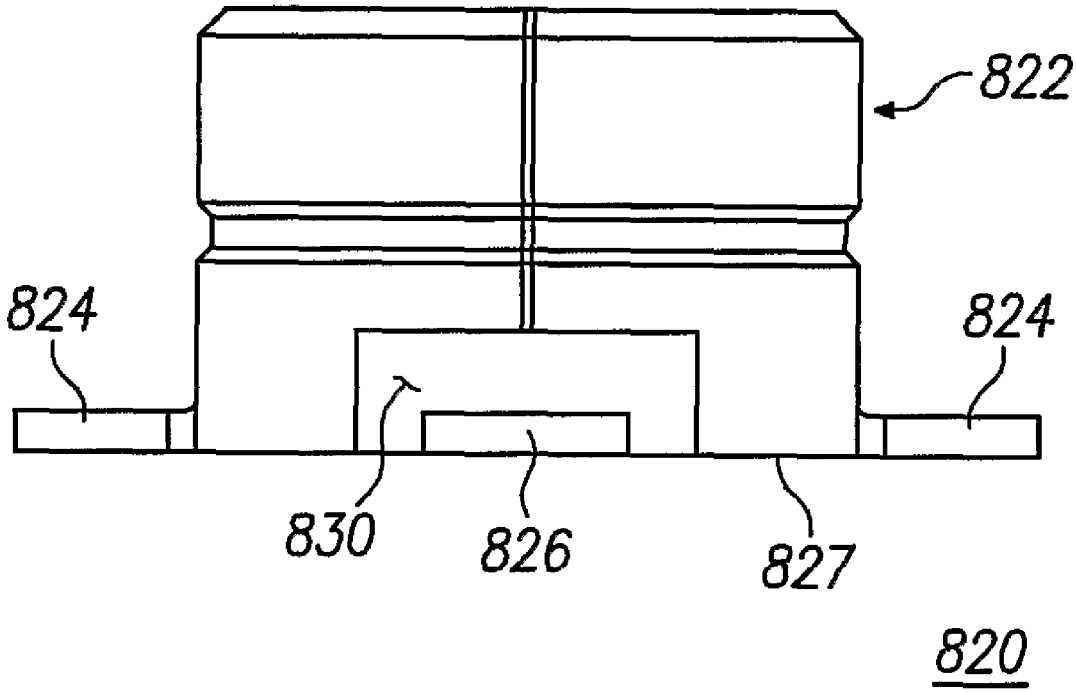
FIGS. 15A to 15C are front view, top side view and side view of metal shell which consists of a male connector according to the present invention.
Figure 15B:
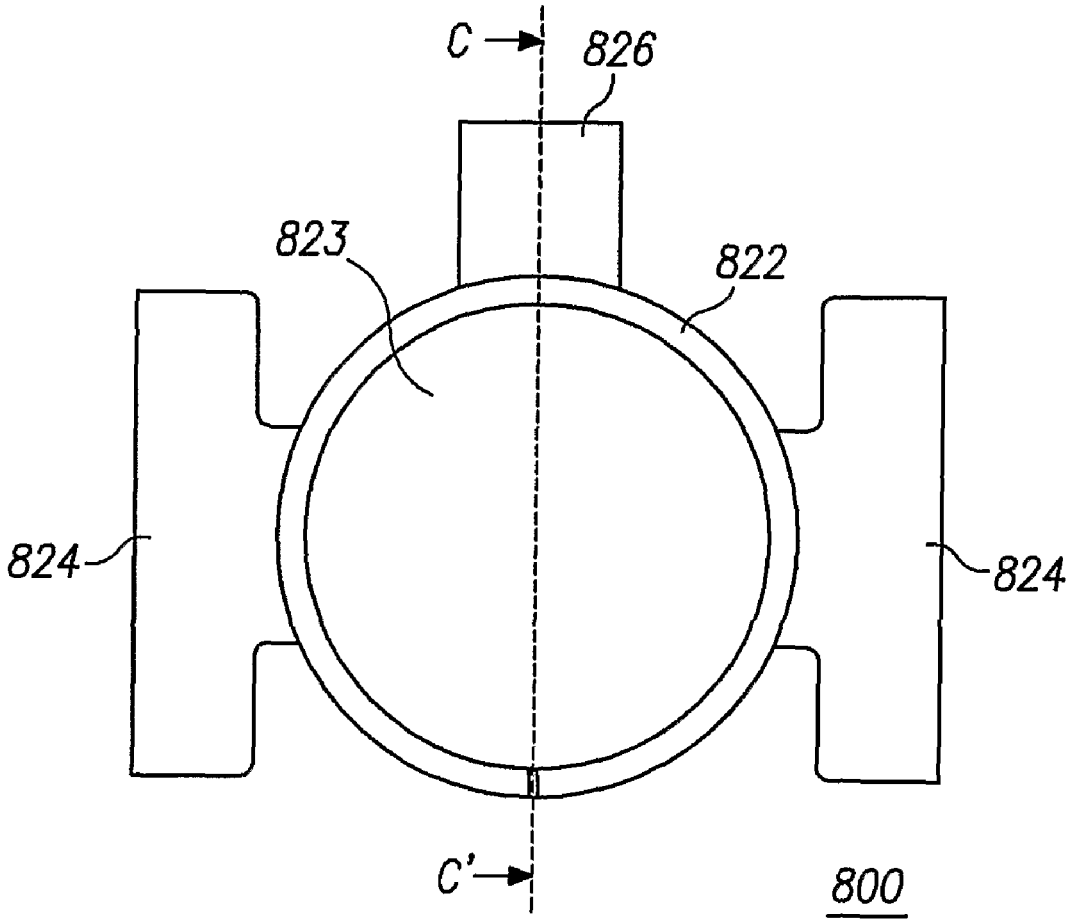
Figure 15C:
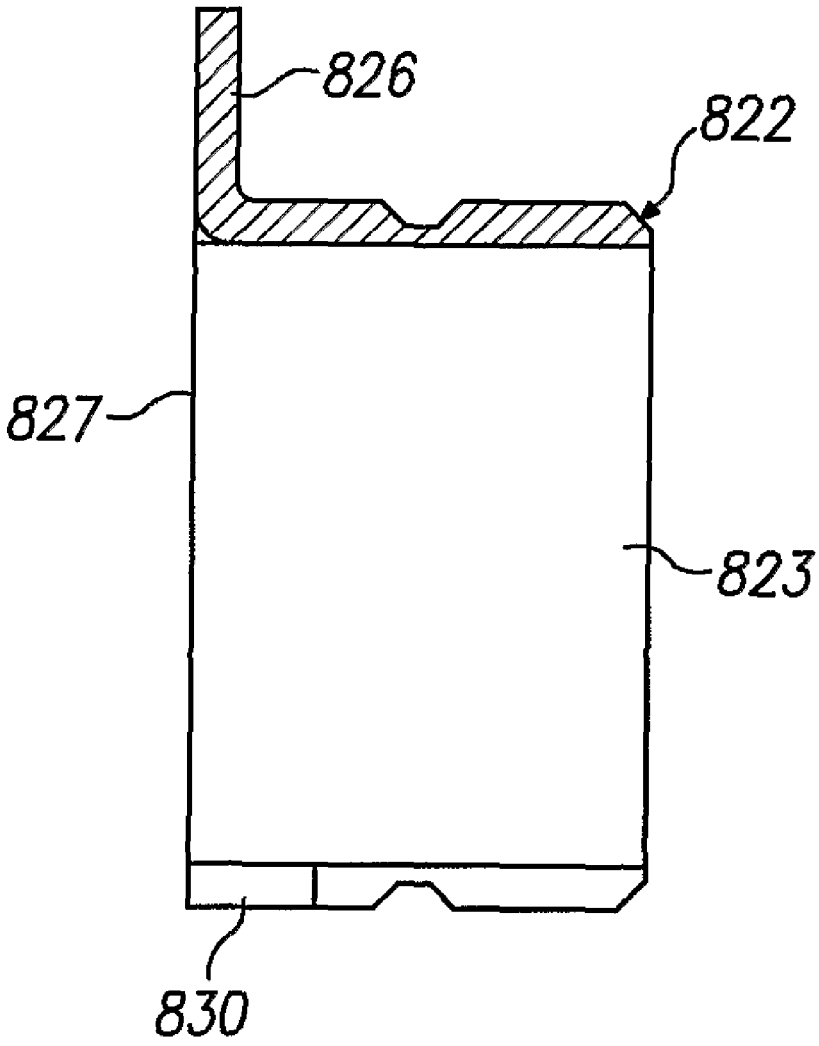

Referring to FIGS. 15A to 15C, the metal shell 820 consisting of the male connector of the present invention includes a cylindrical portion 822, a soldering tag 824 and a connection portion 826. In the cylindrical portion 822 is formed a through hole 823 to which a coaxial connector is inserted.

The metal shell 820 has an opening 830 at the lower part of the cylindrical portion 822. The opening 830 is connected to the through hole 823 for allowing the passage of the central contact ('850' of FIG. 16).

Figure 16A:
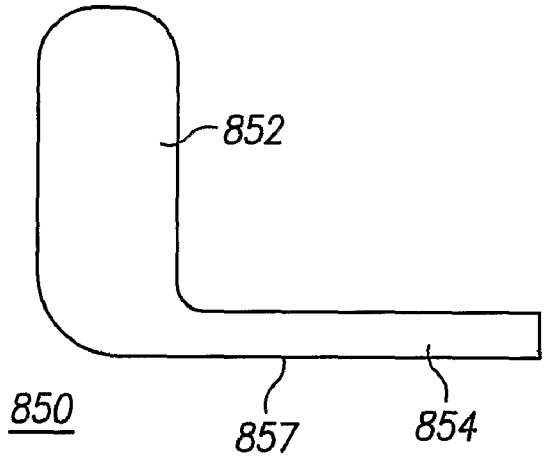
FIGS. 16A to 16C are front view, top side view, and side view of central contact which consists of the male connector of the present invention.
Figure 16B:
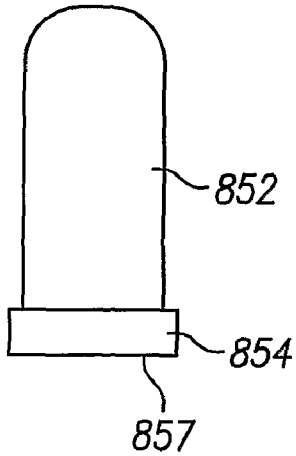
Figure 16C:
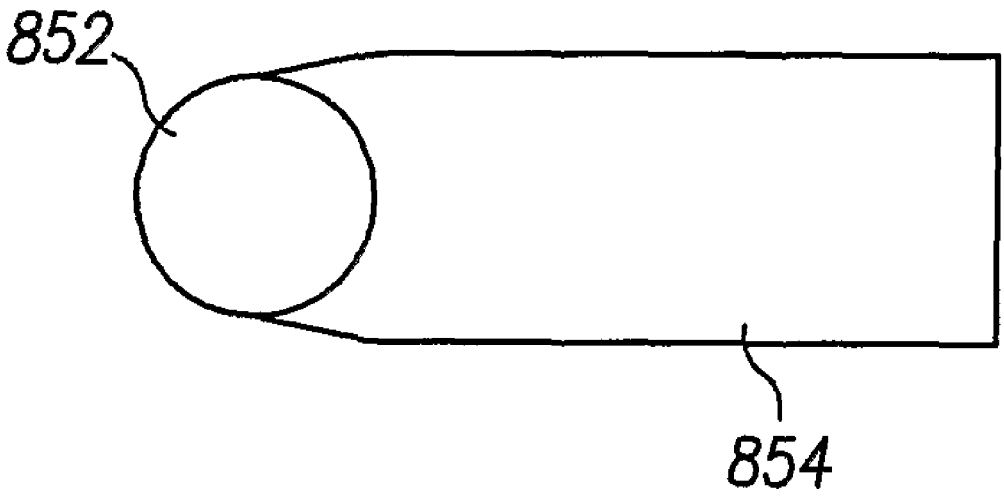

Referring to FIGS. 16A to 16C, the central contact 850 is comprised of a central pin 852 and a base 854. The central pin 852 and base 854 form a single body and connected each other perpendicularly.

The central contact 850 is coupled to the metal shell 820 with maintaining the bottom surface 857 of the base 854 shown in FIGS. 16A and 16B to be coincide the bottom surface 827 of the metal shell 820 shown in FIGS. 15A and 15C. The base 854 of the central contact 850 passes through the opening 830 of the metal shell 820. Therefore, even when the metal shell 820 is assembled with the central contact 850, the overall height of the assembled male connector is identical to the height of the cylindrical portion 822 of the metal shell 820 and there is no increase in the height due to the base 854 of the central contact 850. In contrast, the conventional male connector 300 has a height added by the diameter of central contact 310 and the height of the metal shell 320 as shown in FIG. 7.

For the perpendicular connection of the base 854 and central pin 852 in the central contact 850 as shown in FIG. 16, the following processes can be adopted.

(1) Prepare a metal cylinder having a diameter identical to the central pin 852.

(2) Press a part of the prepared metal cylinder (part for forming the base 854) to be made flat, and then bent the flat part by 90 degrees.

The assembled structure of the coaxial connector 1300 and the male connector 870 according to the third embodiment is shown in FIGS. 17A to 17D. In the coaxial connector 1300 of the third embodiment, the central conductor 978 is easily soldered to the pin 710 of the connector 1300, because the central conductor 978 of the coaxial cable 970 is exposed through the space 980 when the coaxial cable 970 including a jacket 972, a ground conductor 974, a dielectric member 976 and a central conductor 978 is inserted after the pin 710 is inserted into the dielectric block 730 and coupled to the main body 750.

Figure 17A:
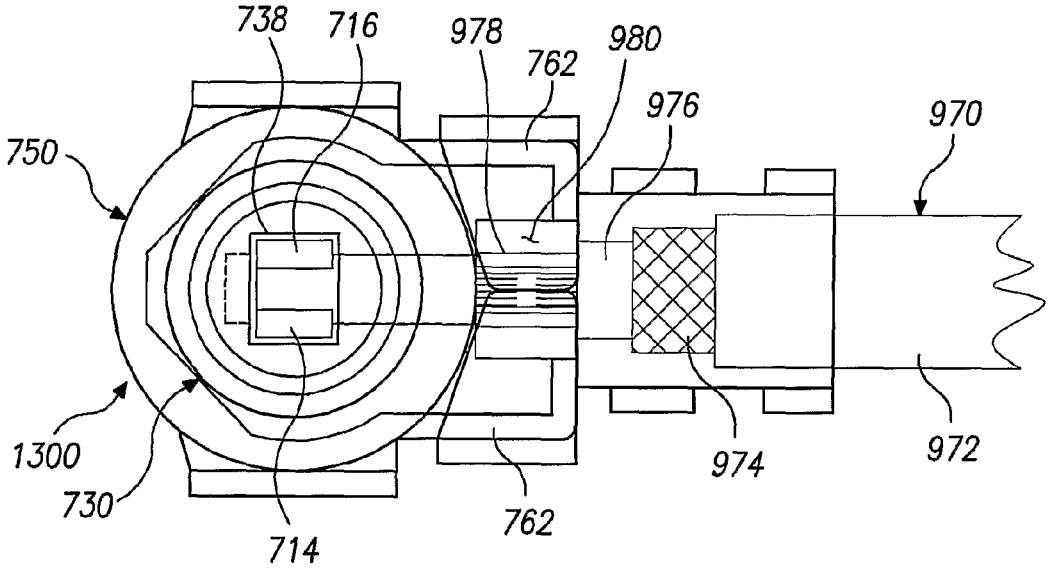
FIGS. 17A to 17D are top side view, cross sectional view, and side view respectively for showing the coupling structure of the coaxial connector of the third embodiment of the present invention to a male connector.
Figure 17B:
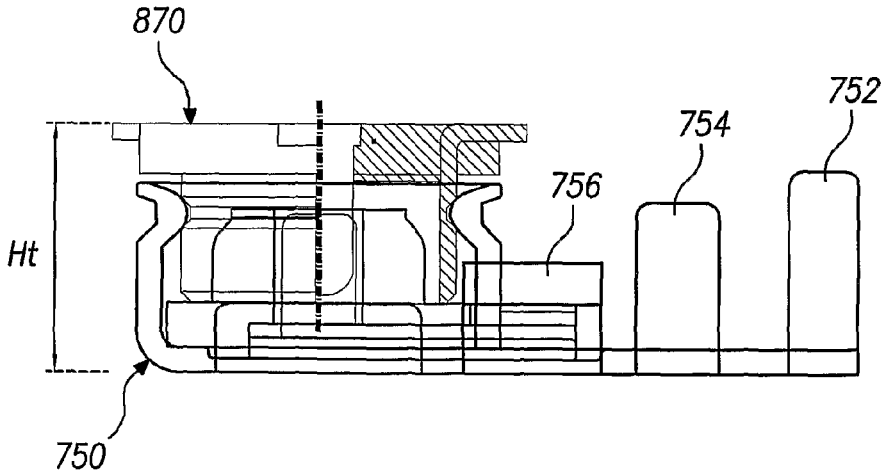
Figure 17C:
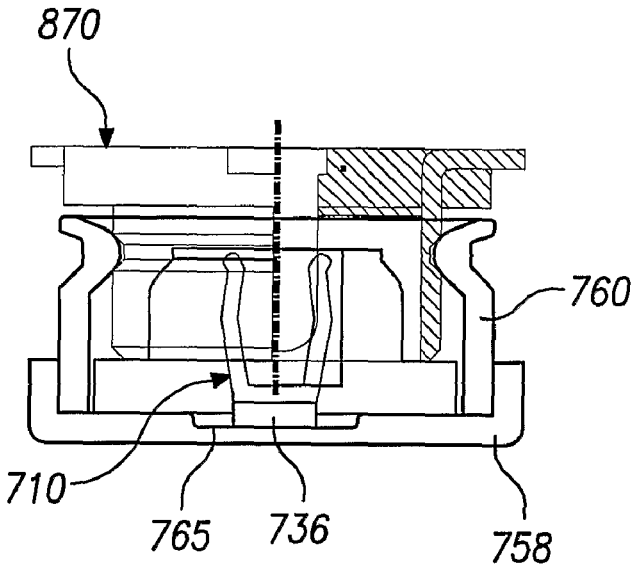
Figure 17D:
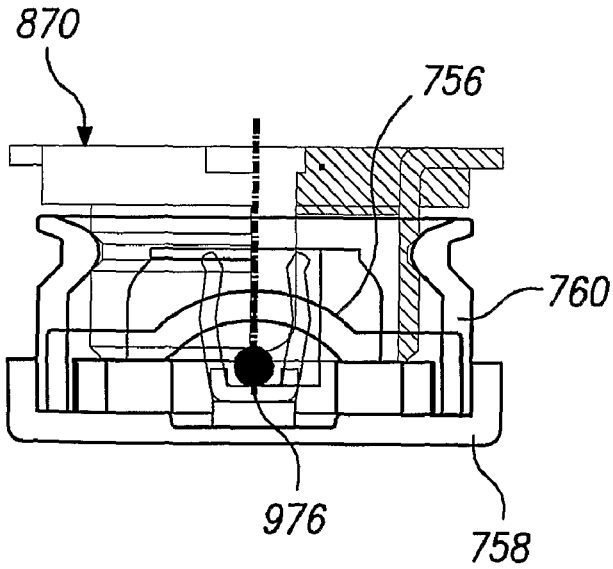

In FIG. 17B, 'Ht' represents the height of the assembled structure of the coaxial connector 1300 and the male connector 870 according to the third embodiment of the present invention.

Figure 18:
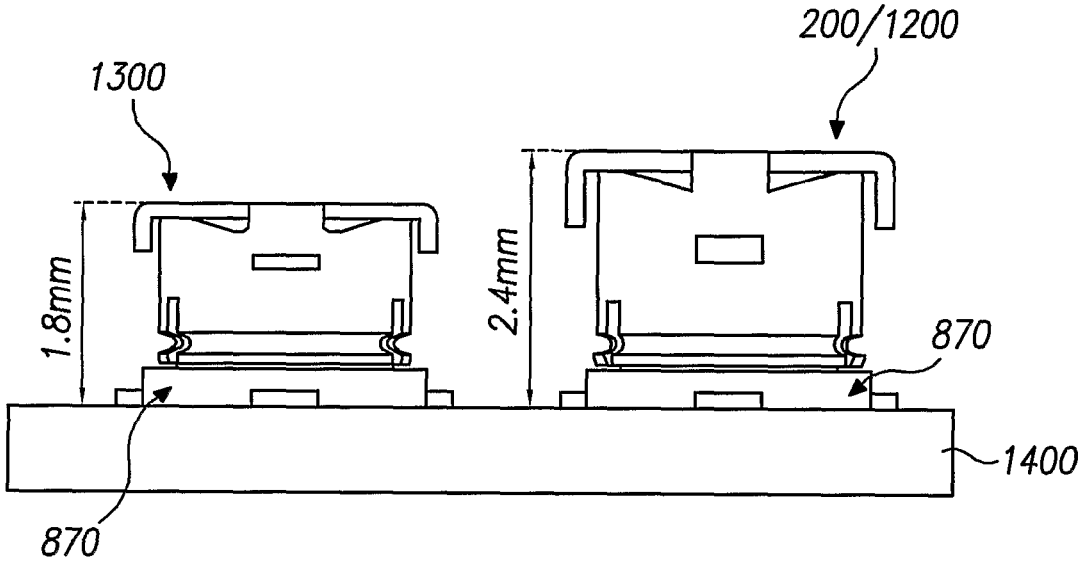
FIG. 18 is a cross sectional view for showing the difference between the mounting heights of coaxial connectors of the first and second embodiments of the present invention and of the conventional coaxial connector.

Referring to FIG. 18, when the coaxial connector 200 of the first embodiment and coaxial connector 1200 of the second embodiment are coupled to the male connector 870 and the coupled structure is mounted on a circuit board 1400, the height is e.g., 2.4 mm and the coaxial connector 1300 of the third embodiment has a mounting height of e.g., 1.8 mm.

Figure 19:
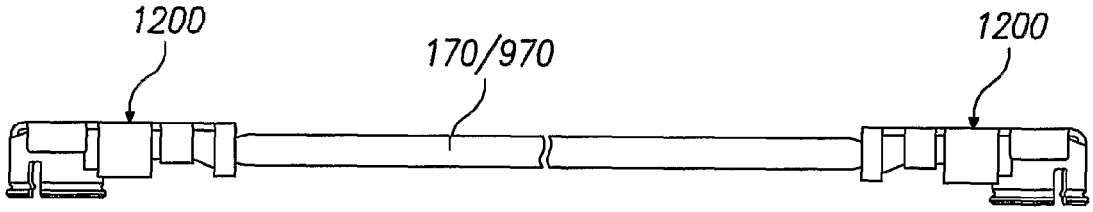
FIG. 19 illustrates a test cable for testing characteristics of the coaxial connector according to the second embodiment of the present invention.

For verifying the technical effect of the present invention, the inventors have measured insertion losses and return losses of the coaxial connector 1200 of the second embodiment and compare the measured data with data from the conventional connector. In the measurement, a coaxial connector 1200 of the second embodiment of the present invention is coupled to both ends of a coaxial cable 170/970 having a length of 100 mm as shown in FIG. 19 and the insertion loss and return loss are measured by connecting the coaxial cable to a DUT (Device Under Unit) of HP 8510C (network analyzer of Hewlett-Packard Development Company) under the conditions of 3.5 mm full 2-port calibration and frequency of 1~7 GHz.

Figure 20:
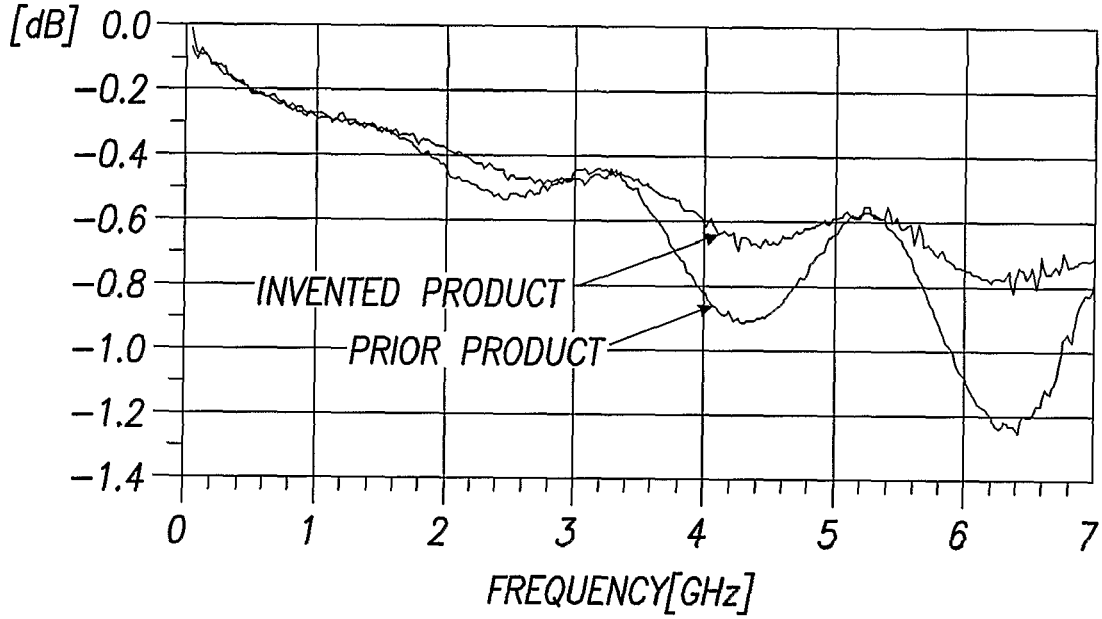
FIG. 20 is a graph for showing the insertion loss of the coaxial connector according to the present invention and the conventional coaxial connector.

As shown in FIG. 20, the insertion loss of the conventional structure has maximum of −1.2 dB, while the insertion loss of coaxial connector 1200 of the present invention is greatly reduced to maximum of −0.8 dB. The insertion loss is measure represented by logarithm of the loss of a signal line viewed from a terminal 2 when a signal is sent from terminal 1 to terminal 2 of the test DUT.

Figure 21:
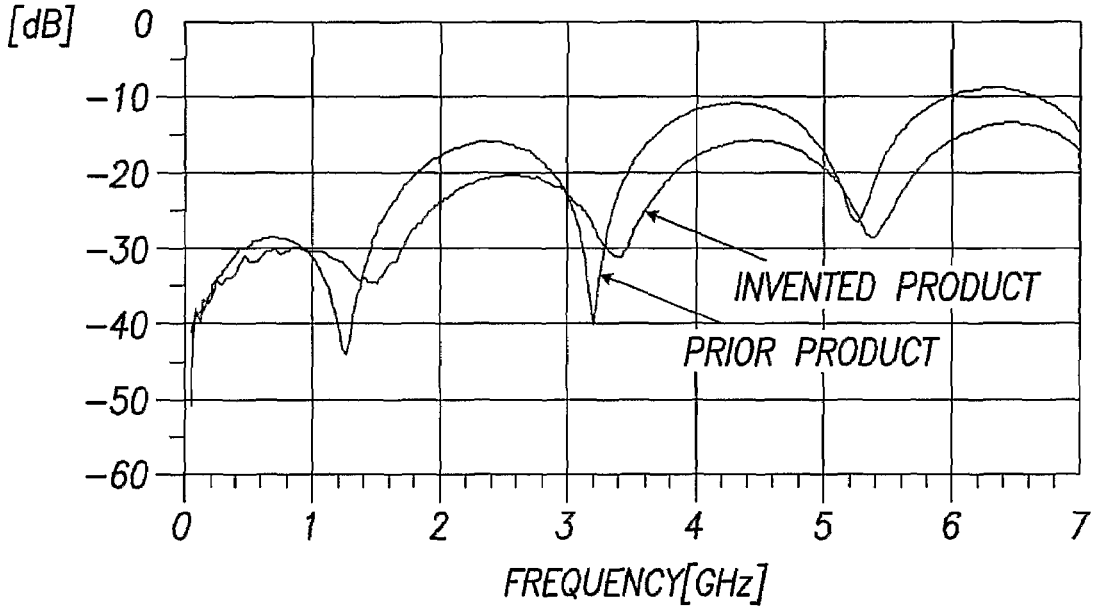
FIG. 21 is a graph for showing the return loss of the coaxial connector according to the present invention and the conventional coaxial connector.

Further, as shown in FIG. 21, the return loss of the conventional structure is large as −10 dB, while the return loss of the coaxial connector 1200 is significantly reduced to −13 dB. The return loss is measure represented by logarithm of the signal returning from terminal 2 to terminal 1. For instance, '10' is return when '100' is sent, the return loss is −10 dB.

Figure 22A:
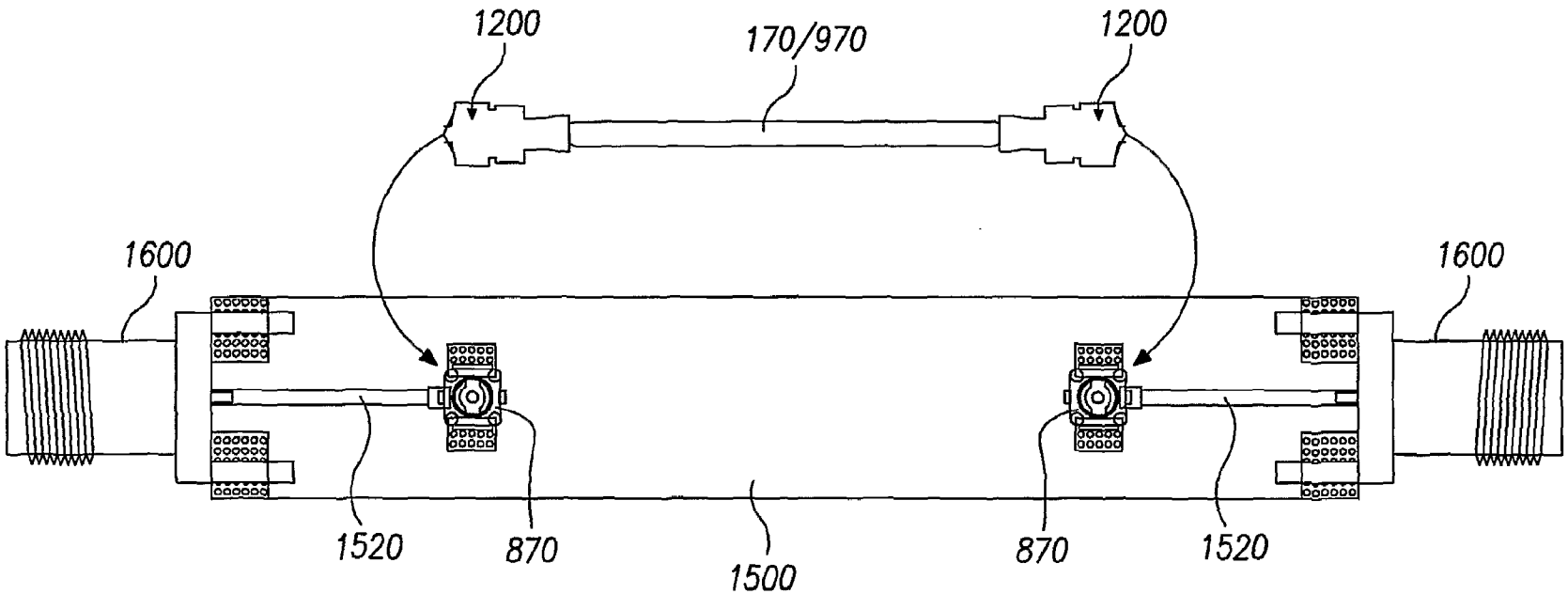
FIGS. 22A and 22B illustrates the structure of device under unit (DUT) for testing the characteristics of the coaxial connector according to the present invention.
Figure 22B:
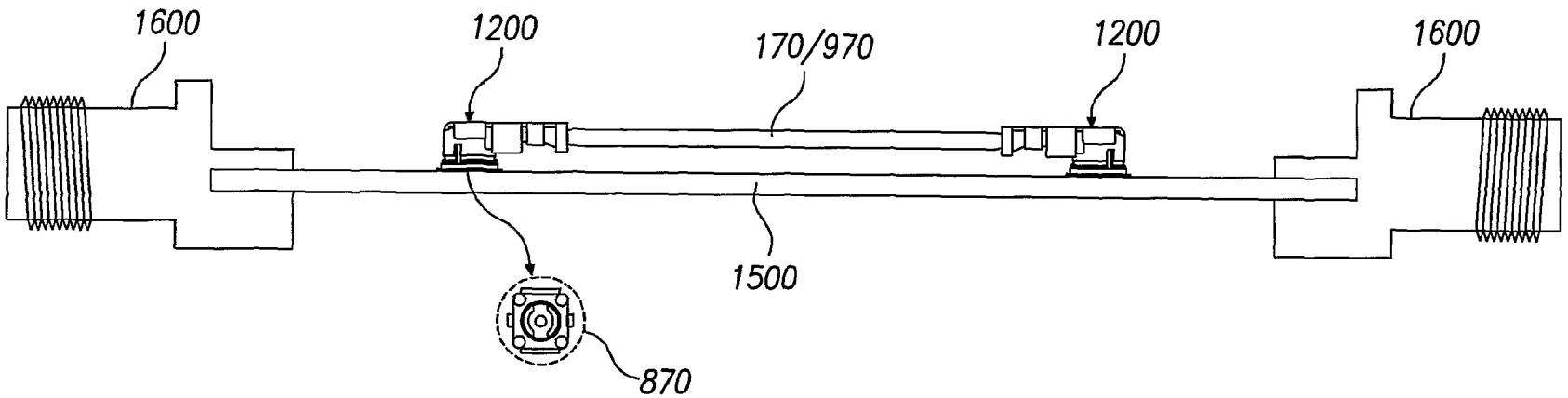

Next, for measuring the insertion loss of the overall structure using the coaxial connector 1200, the coaxial connector 1200 is assembled as shown in FIGS. 22A and 22B. Referring to FIGS. 22A and 22B, a male connector 870 of 50Ω is mounted on R04003 board of Rogers and the male connector 870 is coupled to a transmission line 1520 of 50Ω. A test DUT is prepared by connecting the transmission line to a test equipment (HP 8510C) through a SMA connector 1600 of 50Ω. Then, to both ends of the coaxial cable 170/790 having a length of 100 mm is connected the coaxial connector 1200 of the present invention, and the structure is connected to the test DUT.

Figure 23:
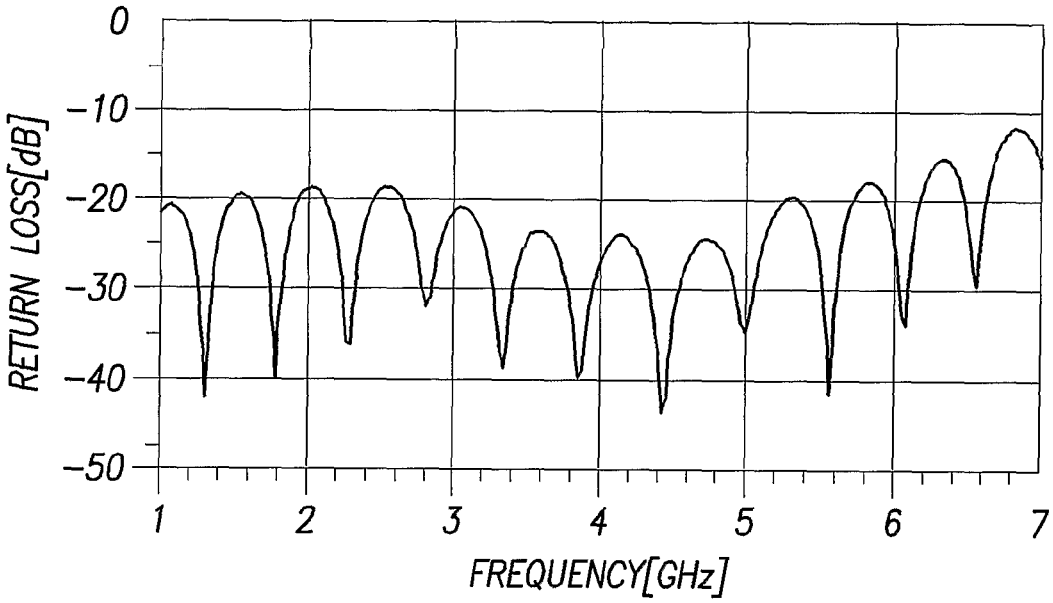
FIG. 23 is a graph for showing the overall return loss of the coaxial connector according to the present invention when it is coupled to the DUT.

As shown in FIG. 23, the return loss of the overall DUT is about −20 dB at 6 GHz frequency and −12 dB at 7 GHz frequency. The return loss of −20 dB means that when '100' signal is sent, just '1' signal is returned.

Although the present invention has been described above with reference to the preferred embodiments and the accompanying drawings, the scope of rights of the present invention is not limited thereto, but rather, shall be determined by the claims attached herein after and their equivalents, allowing various modifications and adaptations without departing the spirit of the present invention, as those skilled in the art to which the present invention belongs will understand.

INDUSTRIAL APPLICABILITY

The present invention is widely applied to various measuring and testing equipments and electronic devices such as mobile telephones, GPS, GPRS, Bluetooth, PCI, wireless LAN, and AP. In particular, the coaxial connector of the present invention is suitable for use in transmission of high frequency signal with the coaxial cable.

Since the coaxial connector according to the present invention allows the soldering operation even after the components for the connector are assembled, the provision of the components is made possible and thus users can customize the coaxial connector to their needs.

Further, the assembling process of the coaxial connector is simple and thus the productivity of the connector is improved.

Moreover, the present invention provides components for the connector, which have structures for preventing electrical shorts and for impedance matching, and therefore the electrical characteristics of the connector are enhanced for use in higher frequency.

In the present invention, the impedance characteristics of a coaxial connector is greatly improved so that more exact impedance matching can be accomplished when the coaxial connector is coupled to a coaxial cable or a male connector and signal transmission without signal loss at higher frequency is made possible. Further, the height of the coaxial connector is significantly reduced.

What is claimed is:

1. A coaxial connector electrically and mechanically interconnected to a coaxial cable having a central conductor and ground conductor, comprising:

a pin having a soldering section to be soldered to a central conductor of the coaxial cable and a contact section extending from the soldering section and electrically interconnected to a male connector;

a dielectric block having a cylindrical portion including a through hole to which the pin is inserted, a body connected to the cylindrical portion, and a cover leg extending from the body in an opposite direction from the cylindrical portion;

a main body having a cylindrical portion including a hole for receiving the dielectric block to which the pin is inserted, a fastening flap for holding the coaxial cable, and a body electrically interconnected to the ground conductor of the coaxial cable;

said body of the dielectric block including shoulder portions for forming a space in an opposite position of the cover leg, and the cylindrical portion of the main body including fold fastening means extending, in parallel, from the cylindrical portion and forming a space between the fold fastening means, so that the soldering section of the pin and the central conductor of the coaxial cable are soldered through both the space between the fold fastening means and the space in the dielectric block; and said soldering section of the pin and the central conductor of the coaxial cable are connected to each other by soldering in a space of which three surfaces are to be enclosed by the shoulder portions and the cover leg, and one surface opposite to the cover leg is to be exposed when the pin, the dielectric block, and the main body are assembled.

2. The coaxial connector of claim 1, wherein the cover leg has a length enough to cover the soldering section of the pin when the cover leg is bent.

3. The coaxial connector of claim 1, wherein the soldering section is of bent structure having U- or V-shape and has a groove in central part, the central conductor of the coaxial cable being soldered to the groove.

4. The coaxial connector of claim 1, wherein the contact section includes first and second contact sections, which is inclined inwardly.

5. The coaxial connector of claim 1, wherein the space between the fold fastening means and the space of the dielectric block are filled by an insulating epoxy after the central conductor of the coaxial cable is soldered.

6. A method for assembling a coaxial connector, which comprises: a pin having a soldering section to be soldered to a central conductor of a coaxial cable and a contact section extending from the soldering section and electrically interconnected to a male connector; a dielectric block having a cylindrical portion including a through hole to which the pin is inserted, a body connected to the cylindrical portion, and a cover leg extending from the body in an opposite direction from the cylindrical portion; and a main body having a cylindrical portion including a hole for receiving the dielectric block to which the pin is inserted, a fastening flap for holding the coaxial cable, and a body electrically interconnected to a ground conductor of the coaxial cable, said body of the dielectric block includes shoulder portions for forming a space in an opposite position of the cover leg, and said soldering section of the pin and the central conductor of the coaxial cable are connected to each other by soldering in a space of which three surfaces are to be enclosed by the shoulder portions and the cover leg, and one surface opposite to the cover leg is to be exposed when the pin, the dielectric block, and the main body are assembled, said method comprises the steps of:

(i) coupling the pin to the dielectric block by inserting the contact section of the pin into the through hole of the dielectric block;

(ii) coupling the dielectric block into the hole formed in the cylindrical portion of the main body;

(iii) bending by 90 degrees the cylindrical portion of the main body;

(iv) soldering the central conductor of the coaxial cable and the soldering section of the pin after inserting the coaxial cable to the main body so that the central conductor of the coaxial cable reaches to the soldering section of the pin; and (v) bending the contact section of the main body to fix the coaxial cable.

7. A coaxial connector electrically and mechanically interconnected to a coaxial cable having a central conductor and ground conductor, comprising:

a pin having a soldering section to be soldered to a central conductor of the coaxial cable and a contact section extending from the soldering section and electrically interconnected to a male connector;

a dielectric block having a cylindrical portion including a through hole to which the pin is inserted, a body connected to the cylindrical portion, and a cover leg extending from the body in an opposite direction from the cylindrical portion;

a main body having a cylindrical portion including a hole for receiving the dielectric block to which the pin is inserted, a fastening flap for holding the coaxial cable, and a body electrically interconnected to the ground conductor of the coaxial cable;

said body of the dielectric block including shoulder portions for forming a space in an opposite position of the cover leg, and the cylindrical portion of the main body including fold fastening means extending, in parallel, from the cylindrical portion and forming a space between the fold fastening means, so that the soldering section of the pin and the central conductor of the coaxial cable are soldered through both the space between the fold fastening means and the space in the dielectric block;

said body of the dielectric block is of a chamfered structure; and said soldering section of the pin and the central conductor of the coaxial cable are connected to each other by soldering in a space of which three surfaces are to be enclosed by the shoulder portions and the cover leg, and one surface opposite to the cover leg is to be exposed when the pin, the dielectric block, and the main body are assembled.

8. The coaxial connector of claim 7, wherein the bottom of the pin is flat.

9. The coaxial connector of claim 7, wherein the contact section extends, in bent structure, from the soldering section.

10. The coaxial connector of claim 7, wherein the end surface of the soldering section of the pin coincides with the end surface of the contact section.

11. The coaxial connector of claim 7, wherein the shoulder portion of the body of dielectric block extends from the body of the dielectric block at a position that is distant inwardly from an end surface of the body along a width direction of the body.

12. The coaxial connector of claim 7, wherein the shoulder portion of the body of dielectric block extends from the body of the dielectric block at a position that is distance from a top surface of the body along a height direction of the body.

13. The coaxial connector of claim 7, wherein the fold fastening means of the main body is an arc closed structure.

14. The coaxial connector of claim 7, wherein the main body has a flat bottom surface between the fastening flaps for holding the cylindrical portion.

15. The coaxial connector of claim 7, wherein the main body has an embossed portion at a bottom surface between the fastening flaps for holding the coaxial cable.

16. A coaxial connector electrically and mechanically interconnected to a coaxial cable having a central conductor and ground conductor, comprising:

a pin having a soldering section to be soldered to a central conductor of the coaxial cable and a contact section extending from the soldering section and electrically interconnected to a male connector;

a dielectric block having a cylindrical portion including a through hole to which the pin is inserted, a body connected to the cylindrical portion, and a cover leg extending from the body in an opposite direction from the cylindrical portion;

a main body having a cylindrical portion including a hole for receiving the dielectric block to which the pin is inserted, a fastening flap for holding the coaxial cable, and a body electrically interconnected to the ground conductor of the coaxial cable;

said body of the dielectric block including shoulder portions for forming a space in an opposite position of the cover leg, and the cylindrical portion of the main body including fold fastening means extending, in parallel, from the cylindrical portion and forming a space between the fold fastening means, so that the soldering section of the pin and the central conductor of the coaxial cable are soldered through both the space between the fold fastening means and the space in the dielectric block;

said main body has an embossed portion for receiving the cover leg of the dielectric block when the dielectric block is inserted into the cylindrical portion of the main body; and said soldering section of the pin and the central conductor of the coaxial cable are connected to each other by soldering in a space of which three surfaces are to be enclosed by the shoulder portions and the cover leg, and one surface opposite to the cover leg is to be exposed when the pin, the dielectric block, and the main body are assembled.

17. The coaxial connector of claim 16, wherein the contact section of the pin extends, in bent structure, from the soldering section.

18. The coaxial connector of claim 16, wherein the pin has humps at both ends for preventing overflow of solder.

19. The coaxial connector of claim 18, wherein the soldering section of the pin is lower than the humps.

20. The coaxial connector of claim 16, wherein the body of the dielectric block is of chamfered structure.

21. The coaxial connector of claim 16, wherein end portion of the fastening flaps for holding the coaxial cable is bent to form a circular arc.

22. The coaxial connector of claim 21, wherein the dimension of the circular arc is enough to pass the central conductor of the coaxial cable and the circular arc is not pressed by the coupling force of the coaxial connector to the male connector.

23. The pin used in the coaxial connector of claim 7.

24. The dielectric block used in the coaxial connector of claim 7.

25. The main body used in the coaxial connector of claim 7.

26. A method for assembling a coaxial connector, which comprises: a pin having a soldering section to be soldered to a central conductor of a coaxial cable and a contact section extending from the soldering section and electrically interconnected to a male connector; a dielectric block having a cylindrical portion including a through hole to which the pin is inserted, a body of chamfered structure and being connected to the cylindrical portion, and a cover leg extending from the body in an opposite direction from the cylindrical portion; and a main body having a cylindrical portion including a hole for receiving the dielectric block to which the pin is inserted, a fastening flap for holding the coaxial cable, and a body electrically interconnected to a ground conductor of the coaxial cable, said body of the dielectric block includes shoulder portions for forming a space in an opposite position of the cover leg; and said soldering section of the pin and the central conductor of the coaxial cable are connected to each other by soldering in a space of which three surfaces are to be enclosed by the shoulder portions and the cover leg, and one surface opposite to the cover leg is to be exposed when the pin, the dielectric block, and the main body are assembled, said method includes the steps of:

(i) coupling the pin to the dielectric block by inserting the contact section of the pin into the through hole of the dielectric block;

(ii) coupling the dielectric block into the hole formed in the cylindrical portion of the main body;

(iii) bending by 90 degrees the cylindrical portion of the main body;

(iv) soldering the central conductor of the coaxial cable and the soldering section of the pin after inserting the coaxial cable to the main body so that the central conductor of the coaxial cable reaches to the soldering section of the pin; and (v) bending the contact section of the main body to fix the coaxial cable.

27. A method for assembling a coaxial connector, which comprises: a pin having a soldering section to be soldered to a central conductor of a coaxial cable and a contact section extending from the soldering section and electrically interconnected to a male connector; a dielectric block having a cylindrical portion including a through hole to which the pin is inserted, a body of chamfered structure and being connected to the cylindrical portion, and a cover leg extending from the body in an opposite direction from the cylindrical portion; and a main body having a cylindrical portion including a hole for receiving the dielectric block to which the pin is inserted, a fastening flap for holding the coaxial cable, and a body electrically interconnected to a ground conductor of the coaxial cable, said main body having an embossed portion for receiving the cover leg of the dielectric block when the dielectric block is inserted into the cylindrical portion of the main body, said body of the dielectric block includes shoulder portions for forming a space in an opposite position of the cover leg; and said soldering section of the pin and the central conductor of the coaxial cable are connected to each other by soldering in a space of which three surfaces are to be enclosed by the shoulder portions and the cover leg, and one surface opposite to the cover leg is to be exposed when the pin, the dielectric block, and the main body are assembled, said method includes the steps of:

(i) coupling the pin to the dielectric block by inserting the contact section of the pin into the through hole of the dielectric block;

(ii) coupling the dielectric block into the hole formed in the cylindrical portion of the main body;

(iii) bending by 90 degrees the cylindrical portion of the main body;

(iv) soldering the central conductor of the coaxial cable and the soldering section of the pin after inserting the coaxial cable to the main body so that the central conductor of the coaxial cable reaches to the soldering section of the pin; and (v) bending the contact section of the main body to fix the coaxial cable.

* * * * *